US010614818B2

(12) United States Patent
Schnabel et al.

(10) Patent No.: US 10,614,818 B2
(45) **Date of Patent: *Apr. 7, 2020**

(54) APPARATUS AND METHOD FOR GENERATING AN ERROR CONCEALMENT SIGNAL USING INDIVIDUAL REPLACEMENT LPC REPRESENTATIONS FOR INDIVIDUAL CODEBOOK INFORMATION

(71) Applicant: Fraunhofer-Gesellschaft zur Foerderung der angewandten Forschung e.V., Munich (DE)

(72) Inventors: Michael Schnabel, Geroldsgruen (DE); Jérémie Lecomte, Fuerth (DE); Ralph Sperschneider, Ebermannstadt (DE); Manuel Jander, Hemhofen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/178,143

(22) Filed: Nov. 1, 2018

(65) Prior Publication Data

US 2019/0074018 A1 Mar. 7, 2019

Related U.S. Application Data

(63) Continuation of application No. 15/267,768, filed on Sep. 16, 2016, now Pat. No. 10,140,993, which is a (Continued)

(30) Foreign Application Priority Data

| | | |
|---|---|---|
| Mar. 19, 2014 | (EP) | 14160774 |
| May 5, 2014 | (EP) | 14167007 |
| Jul. 28, 2014 | (EP) | 14178765 |

(51) Int. Cl.
*G10L 19/005* (2013.01)
*G10L 19/06* (2013.01)
(Continued)

(52) U.S. Cl.
CPC ..... *G10L 19/005* (2013.01); *G10L 19/028* (2013.01); *G10L 19/06* (2013.01);
(Continued)

(58) Field of Classification Search
CPC ..... G10L 19/087; G10L 19/0005
See application file for complete search history.

(56) References Cited

U.S. PATENT DOCUMENTS

| | | | |
|---|---|---|---|
| 5,574,825 | A | 11/1996 | Chen et al. |
| 6,208,962 | B1 | 3/2001 | Ozawa |

(Continued)

FOREIGN PATENT DOCUMENTS

| | | | |
|---|---|---|---|
| CN | 1535461 | A | 10/2004 |
| CN | 101207459 | A | 6/2008 |

(Continued)

OTHER PUBLICATIONS

Zheng, Guo-Hong et al., "Lectures on Wideband Speech Coding Technology (I)", Lecture 2, A Wideband Embedded Variable Bit-rate Speech and Audio Codec, ITU-TG.718, Journal of Military Communi-cations Technology vol. 32, No. 2, 2011.

(Continued)

*Primary Examiner* — Douglas Godbold
(74) *Attorney, Agent, or Firm* — Perkins Coie LLP; Michael A. Glenn

(57) ABSTRACT

An apparatus for generating an error concealment signal includes an LPC (linear prediction coding) representation generator for generating a first replacement LPC representation and a different second replacement LPC representation; an LPC synthesizer for filtering a first codebook (Continued)

information using the first replacement representation to obtain a first replacement signal and for filtering a different second codebook information using the second replacement LPC representation to obtain a second replacement signal; and a replacement signal combiner for combining the first replacement signal and the second replacement signal to obtain the error concealment signal.

16 Claims, 17 Drawing Sheets

Related U.S. Application Data continuation of application No. PCT/EP2015/054488, filed on Mar. 4, 2015.

(51) Int. Cl.
*G10L 19/028* (2013.01)
*G10L 19/09* (2013.01)
*G10L 19/00* (2013.01)

(52) U.S. Cl.
CPC ..... *G10L 19/09* (2013.01); *G10L 2019/0002* (2013.01); *G10L 2019/0016* (2013.01)

(56) References Cited

U.S. PATENT DOCUMENTS

| | | | | |
|---|---|---|---|---|
| 6,714,908 | B1 | 3/2004 | Naka | |
| 6,757,654 | B1 | 6/2004 | Westerlund et al. | |
| 7,110,947 | B2 * | 9/2006 | Cox | G10L 15/02 704/236 |
| 7,379,865 | B2 * | 5/2008 | Kang | G10L 19/005 704/219 |
| 7,487,093 | B2 * | 2/2009 | Mutsuno | G10L 13/033 704/258 |
| 7,895,035 | B2 | 2/2011 | Ehara | |
| 8,255,213 | B2 | 8/2012 | Yoshida et al. | |
| 8,301,440 | B2 | 10/2012 | Zopf et al. | |
| 8,468,015 | B2 * | 6/2013 | Ehara | G10L 19/005 345/418 |
| 8,571,204 | B2 | 10/2013 | Li et al. | |
| 8,725,501 | B2 * | 5/2014 | Ehara | G10L 19/005 704/226 |
| 9,837,094 | B2 * | 12/2017 | Subasingha | G10L 19/005 |
| 9,881,627 | B2 * | 1/2018 | Tsutsumi | G10L 19/09 |
| 10,140,993 | B2 * | 11/2018 | Schnabel | G10L 19/06 |
| 10,163,444 | B2 | 12/2018 | Schnabel et al. | |
| 10,224,041 | B2 | 3/2019 | Schnabel et al. | |
| 2002/0077812 | A1 | 6/2002 | Suzuki et al. | |
| 2002/0091523 | A1 | 7/2002 | Makinen et al. | |
| 2003/0055632 | A1 | 3/2003 | Chen | |
| 2004/0010407 | A1 | 1/2004 | Kovesi et al. | |
| 2005/0154584 | A1 | 7/2005 | Jelinek et al. | |
| 2008/0071530 | A1 | 3/2008 | Ehara | |
| 2008/0082343 | A1 | 4/2008 | Maeda et al. | |
| 2008/0154584 | A1 | 6/2008 | Andersen | |
| 2008/0294429 | A1 | 11/2008 | Su et al. | |
| 2009/0109881 | A1 | 4/2009 | Li et al. | |
| 2009/0119098 | A1 | 5/2009 | Zhan et al. | |
| 2009/0204412 | A1 | 8/2009 | Kovesi et al. | |
| 2010/0070271 | A1 | 3/2010 | Kovesi et al. | |
| 2010/0070284 | A1 | 3/2010 | Oh et al. | |
| 2011/0173011 | A1 | 7/2011 | Geiger et al. | |
| 2011/0218801 | A1 | 9/2011 | Vary et al. | |
| 2012/0137189 | A1 | 5/2012 | Macours | |
| 2012/0239389 | A1 | 9/2012 | Jeon et al. | |
| 2012/0265523 | A1 | 10/2012 | Greer et al. | |
| 2012/0271629 | A1 | 10/2012 | Sung et al. | |
| 2013/0028409 | A1 | 1/2013 | Li et al. | |
| 2013/0080175 | A1 * | 3/2013 | Mori | G06F 17/218 704/260 |
| 2017/0004833 | A1 | 1/2017 | Schnabel et al. | |
| 2017/0004834 | A1 | 1/2017 | Schnabel et al. | |
| 2017/0148459 | A1 * | 5/2017 | Tsutsumi | G10L 19/09 |

FOREIGN PATENT DOCUMENTS

| | | | |
|---|---|---|---|
| CN | 101361112 | A | 2/2009 |
| CN | 101395659 | A | 3/2009 |
| CN | 1989548 | B | 12/2010 |
| CN | 102034476 | A | 4/2011 |
| CN | 102171753 | A | 8/2011 |
| CN | 102479513 | A | 5/2012 |
| CN | 102726034 | A | 10/2012 |
| CN | 103597544 | A | 2/2014 |
| CN | 103620675 | A | 3/2014 |
| EP | 1330818 | B1 | 6/2006 |
| EP | 1596364 | B1 | 5/2008 |
| EP | 2088522 | A1 | 8/2009 |
| EP | 2088588 | A1 | 8/2009 |
| EP | 2203915 | B1 | 7/2012 |
| EP | 2518986 | A1 | 10/2012 |
| JP | 07-36496 | A | 2/1995 |
| JP | H07311596 | A | 11/1995 |
| JP | H10308708 | A | 11/1998 |
| JP | 2002 236495 | A | 8/2002 |
| JP | 3316945 | B2 | 8/2002 |
| JP | 2004 508597 | A | 3/2004 |
| JP | 07-311596 | A | 11/2007 |
| JP | 2008 058667 | A | 3/2008 |
| JP | 6450511 | B2 | 12/2018 |
| RU | 2325707 | C2 | 5/2008 |
| RU | 2407071 | C2 | 12/2010 |
| RU | 2455709 | C2 | 7/2012 |
| RU | 2496156 | C2 | 10/2013 |
| WO | 2004038927 | A1 | 5/2004 |
| WO | 2008056775 | A | 5/2008 |
| WO | 2008056775 | A1 | 5/2008 |
| WO | 2009047461 | A1 | 4/2009 |
| WO | 2012/110447 | A1 | 8/2012 |
| WO | 2012/110481 | A1 | 8/2012 |
| WO | 2012110447 | A1 | 8/2012 |
| WO | 2012110481 | A1 | 8/2012 |
| WO | 2012158159 | A1 | 11/2012 |

OTHER PUBLICATIONS

"Universal Mobile Telecommunications System (UMTS); Mandatory Speech Codec speech processing functions AMR Wideband speech codec; Transcoding functions", ETSI TS 126 190 V5.1.0 (Dec. 2001); 3GPP TS 26.190 version 5.1.0 Release 5;, Universal Mobile Telecommunications System (UMTS); Mandatory Speech Codec speech processing functions AMR Wideband speech codec; Transcoding functions (3GPP TS 26.190 version 5.1.0 Release 5), Dec. 2001, 55 pages.

3GPP, TS 26.190, "Technical Specification Group Services and System Aspects; Speech Codec Speech Processing Functions; Adaptive Multi-Rate Wideband (AMRWB) Speech Codec; Transcoding Functions (Release 11)", 3GPP TS 26.190, 3rd Generation Partnership Project, Sep. 2012, 51 pages.

Chen, Juin-Hwey et al., "Adaptive Postfiltering for Quality Enhancement of Coded Speech", IEEE Transactions on Speech and Audio Processing, Jan. 1, 1995, pp. 59-71.

ETSI TS 126, 191 V11.0.0 , "Digital cellular telecommunications sytem (Phase 2+); Universal Mobile Telecommunications System (UMTS); LTE;", Audio codec processing functions; Extended Adaptive Multi-Rate—Wideband (AMR-WB+) codec; Transcoding functions (3GPP TS 26.390 Version 11.0.0 Release 11); Technical Specification, European Telecommunications Standards Institute; ETSI TS 126 290V11.0.0 So, Oct. 2012, 79 pages.

Gibbs, Jon , "Motorola UK LTD United Kingdom: Draft New ITU-T Recommendation G. VBR-EV Frame Error Robust Narrowband and Wideband Embedded Variable Bit-Rate Coding of Speech and Audio from 8-32 Kbit/s", ITU-T Draft: Study period 2005-2008, International Telecommunication Union, Geneva, CH. vol. 9/16, Apr. 22, 2008, pp. 1-243.

(56) References Cited

OTHER PUBLICATIONS

ITU-T Recommendation G.729, "General Aspects of Digital Transmission Systems", Coding of Speech at 8 kbit/s Using Conjugate-Structure Algebraic-Code-Excited Linear-Prediction (CS-ACELP), Mar. 1996, pp. 1-39.
Kondo, Kazuhiro et al., "A Packet Loss Concealment Method Using Recursive Linear Prediction", Department of Electrical Engineering; Yamagata University; Japan, 4 pages.
Martin, Rainer , "Noise Power Spectral Density Estimation Based on Optimal Smoothing and Minimum Statistics", IEEE Transactions on Speech and Audio Processing, vol. 9, No. 5, Jul. 2001, pp. 504-512.
Martin, T. et al., "Learning User Models for an Intelligent Telephone Assistant", Proceedings Joint 9th IFSA World Congress and 20th NAFIPS Intnl. Conf., IEEE, vol. 2, Piscataway, NJ, USA, Cat. No. 01TH8569, 2001, 669-674.
Recommendation, ITU-T G.718 , "Frame Error Robust Narrow-Band and Wideband Embedded Variable Bit-Rate Coding of Speech and Audio from 8-32 Kbits", International Telecommunication Union, Series G: Transmission System and Media, Digital Systems and Networks, Digital Terminal Equipments, Jun. 2008, 257 pages.
Mano, Kazunori, "High-efficiency Coding of Speech", Journal of Signal Processing, Japan, Signal Processing Study Group, Nov. 1998, vol. 2, No. 6, pp. 398-406, pp. 398-406.

* cited by examiner

210

| mode | description |
|---|---|
| 1 | concealement mode |
| 0 | normal decoding mode |

APPARATUS AND METHOD FOR GENERATING AN ERROR CONCEALMENT SIGNAL USING INDIVIDUAL REPLACEMENT LPC REPRESENTATIONS FOR INDIVIDUAL CODEBOOK INFORMATION

CROSS-REFERENCE TO RELATED APPLICATIONS

This application is a continuation of copending U.S. patent application Ser. No. 15/267,768 filed Sep. 16, 2016, which is a continuation of International Application No. PCT/EP2015/054488, filed Mar. 4, 2015, which is incorporated herein by reference in its entirety, and additionally claims priority from European Applications Nos. EP EP14160774.7, filed Mar. 19, 2014, EP 14167007.5, filed May 5, 2014, and EP 14178765.5, filed Jul. 28, 2014, all of which are incorporated herein by reference in their entirety.

The present invention relates to audio coding and in particular to audio coding based on LPC-like processing in the context of codebooks.

BACKGROUND OF THE INVENTION

Perceptual audio coders often utilize linear predictive coding (LPC) in order to model the human vocal tract and in order to reduce the amount of redundancy, which can be modeled by the LPC parameters. The LPC residual, which is obtained by filtering the input signal with the LPC filter, is further modeled and transmitted by representing it by one, two or more codebooks (examples are: adaptive codebook, glottal pulse codebook, innovative codebook, transition codebook, hybrid codebooks consisting of predictive and transform parts).

In case of a frame loss, a segment of speech/audio data (typically 10 ms or 20 ms) is lost. To make this loss as less audible as possible, various concealment techniques are applied. These techniques usually consist of extrapolation of the past, received data. This data may be: gains of codebooks, codebook vectors, parameters for modeling the codebooks and LPC coefficients. In all concealment technology known from state-of-the-art, the set of LPC coefficients, which is used for the signal synthesis, is either repeated (based on the last good set) or is extra-/interpolated.

ITU G.718 [1]: The LPC parameters (represented in the ISF domain) are extrapolated during concealment. The extrapolation consists of two steps. First, a long term target ISF vector is calculated. This long term target ISF vector is a weighted mean (with the fixed weighting factorbeta) of

- an ISF vector representing the average of the last three known ISF vectors, and
- an offline trained ISF vector, which represents a long-term average spectral shape.

This long term target ISF vector is then interpolated with the last correctly received ISF vector once per frame using a time-varying factor alpha to allow a cross-fade from the last received ISF vector to the long term target ISF vector. The resulting ISF vector is subsequently converted back to the LPC domain, in order to generate intermediate steps (ISFs are transmitted every 20 ms, interpolation generates a set of LPCs every 5 ms). The LPCs are then used to synthesize the output signal by filtering the result of the sum of the adaptive and the fixed codebook, which are amplified with the corresponding codebook gains before addition. The fixed codebook contains noise during concealment. In case of consecutive frame loss, the adaptive codebook is fed back without adding the fixed codebook. Alternatively, the sum signal might be fed back, as done in AMR-WB [5].

In [2], a concealment scheme is described which utilizes two sets of LPC coefficients. One set of LPC coefficients is derived based on the last good received frame, the other set of LPC parameters is derived based on the first good received frame, but it is assumed that the signal evolves in reverse direction (towards the past). Then prediction is performed in two directions, one towards the future and one towards the past. Therefore, two representations of the missing frame are generated. Finally, both signals are weighted and averaged before being played out.

FIG. 8 shows an error concealment processing in accordance with conventional technology. An adaptive codebook 800 provides an adaptive codebook information to an amplifier 808 which applies a codebook gain $g_p$ to the information from the adaptive codebook 800. The output of the amplifier 808 is connected to an input of a combiner 810. Furthermore, a random noise generator 804 together with a fixed codebook 802 provides codebook information to a further amplifier $g_c$. The amplifier $g_c$ indicated at 806 applies the gain factor $g_c$, which is the fixed codebook gain, to the information provided by the fixed codebook 802 together with the random noise generator 804. The output of the amplifier 806 is then additionally input into the combiner 810. The combiner 810 adds the result of both codebooks amplified by the corresponding codebook gains to obtain a combination signal which is then input into an LPC synthesis block 814. The LPC synthesis block 814 is controlled by replacement representation which is generated as discussed before.

This conventional-technology procedure has certain drawbacks.

In order to cope with changing signal characteristics or in order to converge the LPC envelope towards background noise like-properties, the LPC is changed during concealment by extra/interpolation with some other LPC vectors. There is no possibility to precisely control the energy during concealment. While there is the chance to control the codebook gains of the various codebooks, the LPC will implicitly influence the overall level or energy (even frequency dependent).

It might be envisioned to fade out to a distinct energy level (e.g. background noise level) during burst frame loss. This is not possible with state-of-the-art technology, even by controlling the codebook gains.

It is not possible to fade the noisy parts of the signal to background noise, while maintaining the possibility to synthesize tonal parts with the same spectral property as before the frame loss.

SUMMARY

According to an embodiment, an apparatus for generating an error concealment signal may have: an LPC (linear prediction coding) representation generator for generating a first replacement LPC representation and a different second replacement LPC representation; an LPC synthesizer for filtering a first codebook information using the first replacement representation to acquire a first replacement signal and for filtering a different second codebook information using the second replacement LPC representation to acquire a second replacement signal; and a replacement signal combiner for combining the first replacement signal and the second replacement signal by summing-up the first replacement signal and the second replacement signal to acquire the error concealment signal.

According to another embodiment, a method of generating an error concealment signal may have the steps of: generating a first replacement LPC representation and a different second replacement LPC representation; filtering a first codebook information using the first replacement representation to acquire a first replacement signal and filtering a different second codebook information using the second replacement LPC representation to acquire a second replacement signal; and combining the first replacement signal and the second replacement signal by summing-up the first replacement signal and the second replacement signal to acquire the error concealment signal.

According to another embodiment, a non-transitory digital storage medium may have a computer program stored thereon to perform the method of generating an error concealment signal, which method may have the steps of: generating a first replacement LPC representation and a different second replacement LPC representation; filtering a first codebook information using the first replacement representation to acquire a first replacement signal and filtering a different second codebook information using the second replacement LPC representation to acquire a second replacement signal; and combining the first replacement signal and the second replacement signal by summing-up the first replacement signal and the second replacement signal to acquire the error concealment signal, when said computer program is run by a computer.

In an aspect of the present invention, the apparatus for generating an error concealment signal comprises an LPC representation generator for generating a first replacement LPC representation and a different, second replacement LPC representation. Furthermore, an LPC synthesizer is provided for filtering a first codebook information using the first replacement LPC representation to obtain a first replacement signal and for filtering a second different codebook information using the second replacement LPC representation to obtain a second replacement signal. The outputs of the LPC synthesizer are combined by a replacement signal combiner combining the first replacement signal and the second replacement signal to obtain the error concealment signal.

The first codebook is advantageously an adaptive codebook for providing the first codebook information and the second codebook as advantageously a fixed codebook for providing the second codebook information. In other words, the first codebook represents the tonal part of the signal and the second or fixed codebook represents the noisy part of the signal and therefore can be considered to be a noise codebook.

The first codebook information for the adaptive codebook is generated using a mean value of last good LPC representations, the last good representation and a fading value. Furthermore, the LPC representation for the second or fixed codebook is generated using the last good LPC representation fading value and a noise estimate. Depending on the implementation, the noise estimate can be a fixed value, an offline trained value or it can be adaptively derived from a signal preceding an error concealment situation.

Advantageously, an LPC gain calculation for calculating an influence of a replacement LPC representation is performed and this information is then used in order to perform a compensation so that the power or loudness or, generally, an amplitude-related measure of the synthesis signal is similar to the corresponding synthesis signal before the error concealment operation.

In a further aspect, an apparatus for generating an error concealment signal comprises an LPC representation generator for generating one or more replacement LPC representations. Furthermore, the gain calculator is provided for calculating the gain information from the LPC representation and a compensator is then additionally provided for compensating a gain influence of the replacement LPC representation and this gain compensation operates using the gain operation provided by the gain calculator. An LPC synthesizer then filters a codebook information using the replacement LPC representation to obtain the error concealment signal, wherein the compensator is configured for weighting the codebook information before being synthesized by the LPC synthesizer or for weighting the LPC synthesis output signal. Thus, any gain or power or amplitude-related perceivable influence at the onset of an error concealment situation is reduced or eliminated.

This compensation is not only useful for individual LPC representations as outlined in the above aspect, but is also useful in the case of using only a single LPC replacement representation together with a single LPC synthesizer.

The gain values are determined by calculating impulse responses of the last good LPC representation and a replacement LPC representation and by particularly calculating an rms value over the impulse response of the corresponding LPC representation over a certain time which is between 3 and 8 ms and is advantageously 5 ms.

In an implementation, the actual gain value is determined by dividing a new rms value, i.e. an rms value for a replacement LPC representation by an rms value of good LPC representation.

Advantageously, the single or several replacement LPC representations is/are calculated using a background noise estimate which is advantageously a background noise estimate derived from the currently decoded signals in contrast to an offline trained vector simply predetermined noise estimate.

In a further aspect, an apparatus for generating a signal comprises an LPC representation generator for generating one or more replacement LPC representations, and an LPC synthesizer for filtering a codebook information using the replacement LPC representation. Additionally, a noise estimator for estimating a noise estimate during a reception of good audio frames is provided, and this noise estimate depends on the good audio frames. The representation generator is configured to use the noise estimate estimated by the noise estimator in generating the replacement LPC representation.

Spectral representation of a past decoded signal is process to provide a noise spectral representation or target representation. The noise spectral representation is converted into a noise LPC representation and the noise LPC representation is advantageously the same kind of LPC representation as the replacement LPC representation. ISF vectors are advantageous for the specific LPC-related processing procedures.

Estimate is derived using a minimum statistics approach with optimal smoothing to a past decoded signal. This spectral noise estimate is then converted into a time domain representation. Then, a Levinson-Durbin recursion is performed using a first number of samples of the time domain representation, where the number of samples is equal to an LPC order. Then, the LPC coefficients are derived from the result of the Levinson-Durbin recursion and this result is finally transformed in a vector. The aspect of using individual LPC representations for individual codebooks, the aspect of using one or more LPC representations with a gain compensation and the aspect of using a noise estimate in generating one or more LPC representations, which estimate is not an offline-trained vector but is a noise estimate derived from the past decoded signal are individually useable for obtaining an improvement with respect to conventional technology.

Additionally, these individual aspects can also be combined with each other so that, for example, the first aspect and the second aspect can be combined or the first aspect or the third aspect can be combined or the second aspect and the third aspect can be combined to each other to provide an even improved performance with respect to conventional technology. Even more advantageously, all three aspects can be combined with each other to obtain improvements over conventional technology. Thus, even though the aspects are described by separate figures all aspects can be applied in combination with each other, as can be seen by referring to the enclosed figures and description.

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
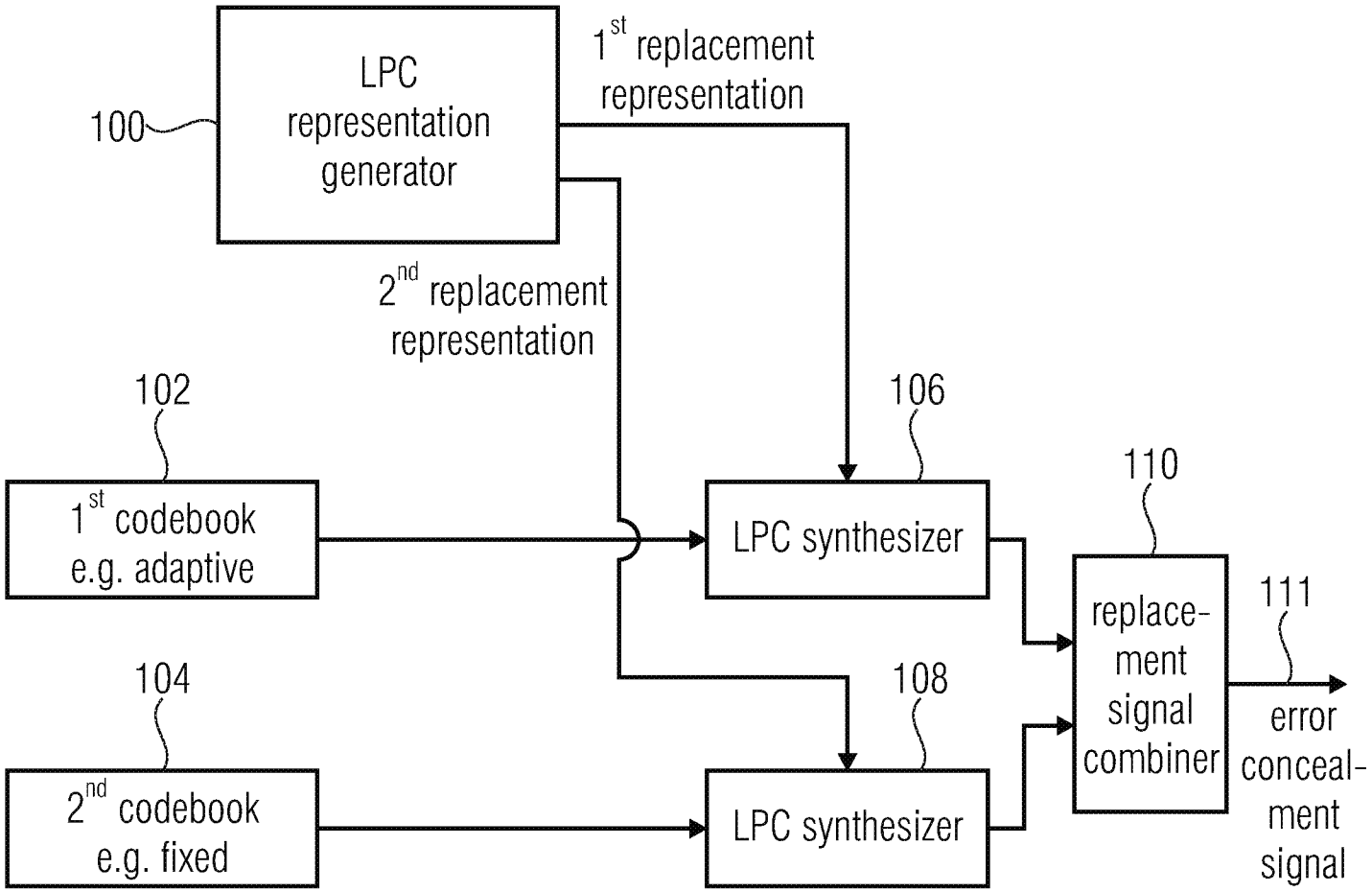
FIG. 1*a* illustrates an embodiment of the first aspect.

Advantageous embodiments of the present invention relate to controlling the level of the output signal by means of the codebook gains independently of any gain change caused by an extrapolated LPC and to control the LPC modeled spectral shape separately for each codebook. For this purpose, separate LPCs are applied for each codebook and compensation means are applied to compensate for any change of the LPC gain during concealment.

Embodiments of the present invention as defined in the different aspects or in combined aspects have the advantage of providing a high subjective quality of speech/audio in case of one or more data packets not being correctly or not being received at all at the decoder side.

Furthermore, the advantageous embodiments compensate the gain differences between subsequent LPCs during concealment, which might result from the LPC coefficients being changed over time, and therefore unwanted level changes are avoided.

Furthermore, embodiments are advantageous in that during concealment two or more sets of LPC coefficients are used to independently influence the spectral behavior of voiced and unvoiced speech parts and also tonal and noise-like audio parts.

All aspects of the present invention provide an improved subjective audio quality.

According to one aspect of this invention, the energy is precisely controlled during the interpolation. Any gain that is introduced by changing the LPC is compensated.

According to another aspect of this invention, individual LPC coefficient sets are utilized for each of the codebook vectors. Each codebook vector is filtered by its corresponding LPC and the individual filtered signals are just afterwards summed up to obtain the synthesized output. In contrast, state-of-the-art technology first adds up all excitation vectors (being generated from different codebooks) and just then feeds the sum to a single LPC filter.

According to another aspect, a noise estimate is not used, for example as an offline-trained vector, but is actually derived from the past decoded frames so that, after a certain amount of erroneous or missing packets/frames, a fade-out to the actual background noise rather than any predetermined noise spectrum is obtained. This particularly results in a feeling of acceptance at a user side, but to the fact that even when an error situation occurs, the signal provided by the decoder after a certain number of frames is related to the preceding signal. However, the signal provided by a decoder in the case of a certain number of lost or erroneous frames is a signal completely unrelated to the signal provided by the decoder before an error situation.

Applying gain compensation for the time-varying gain of the LPC allows the following advantages:

It compensates any gain that is introduced by changing the LPC.

Hence, the level of the output signal can be controlled by the codebook gains of the various codebooks. This allows for a pre-determined fade-out by eliminating any unwanted influence by the interpolated LPC.

Using a separate set of LPC coefficients for each codebook used during concealment allows the following advantages:

It creates the possibility to influence the spectral shape of tonal and noise like parts of the signal separately.

It gives the chance to play out the voiced signal part almost unchanged (e.g. desired for vowels), while the noise part may quickly be converging to background noise.

It gives the chance to conceal voiced parts, and fade out the voiced part with arbitrary fading speed (e.g. fade out speed dependent from signal characteristics), while simultaneously maintaining the background noise during concealment. State-of-the-art codecs usually suffer from a very clean voiced concealment sound.

It provides means to fade to background noise during concealment smoothly, by fading out the tonal parts without changing the spectral properties, and fading the noise like parts to the background spectral envelope.

FIG. 1*a* illustrates an apparatus for generating an error concealment signal 111. The apparatus comprises an LPC representation generator 100 for generating a first replacement representation and additionally for generating a second replacement LPC representation. As outlined in FIG. 1*a*, the first replacement representation is input into an LPC synthesizer 106 for filtering a first codebook information output by a first codebook 102 such as an adaptive codebook 102 to obtain a first replacement signal at the output of block 106. Furthermore, the second replacement representation generated by the LPC representation generator 100 is input into the LPC synthesizer for filtering a second different codebook information provided by a second codebook 104 which is, for example, a fixed codebook, to obtain a second replacement signal at the output of block 108. Both replacement signals are then input into a replacement signal combiner 110 for combining the first replacement signal and the second replacement signal to obtain the error concealment signal 111. Both LPC synthesizers 106, 108 can be implemented in a single LPC synthesizer block or can be implemented as separate LPC synthesizer filters. In other implementations, both LPC synthesizer procedures can be implemented by two LPC filters actually being implemented and operating in parallel. However, the LPC synthesis can also be an LPC synthesis filter and a certain control so that the LPC synthesis filter provides an output signal for the first codebook information and the first replacement representation and then, subsequent to this first operation, the control provides the second codebook information and the second replacement representation to the synthesis filter to obtain the second replacement signal in a serial way. Other implementations for the LPC synthesizer apart from a single or several synthesis blocks are clear for those skilled in the art.

Typically, the LPC synthesis output signals are time domain signals and the replacement signal combiner 110 performs a synthesis output signal combination by performing a synchronized sample-by-sample addition. However, other combinations, such as a weighted sample-by-sample addition or a frequency domain addition or any other signal combination can be performed by the replacement signal combiner 110 as well.

Furthermore, the first codebook 102 is indicated as comprising an adaptive codebook and the second codebook 104 is indicated as comprising a fixed codebook. However, the first codebook and the second codebook can be any codebooks such as a predictive codebook as the first codebook and a noise codebook as the second codebook. However, other codebooks can be glottal pulse codebooks, innovative codebooks, transition codebooks, hybrid codebooks consisting of predictive and transform parts, codebooks for individual voice generators such as males/females/children or codebooks for different sounds such as for animal sounds, etc.

Figure 1B:
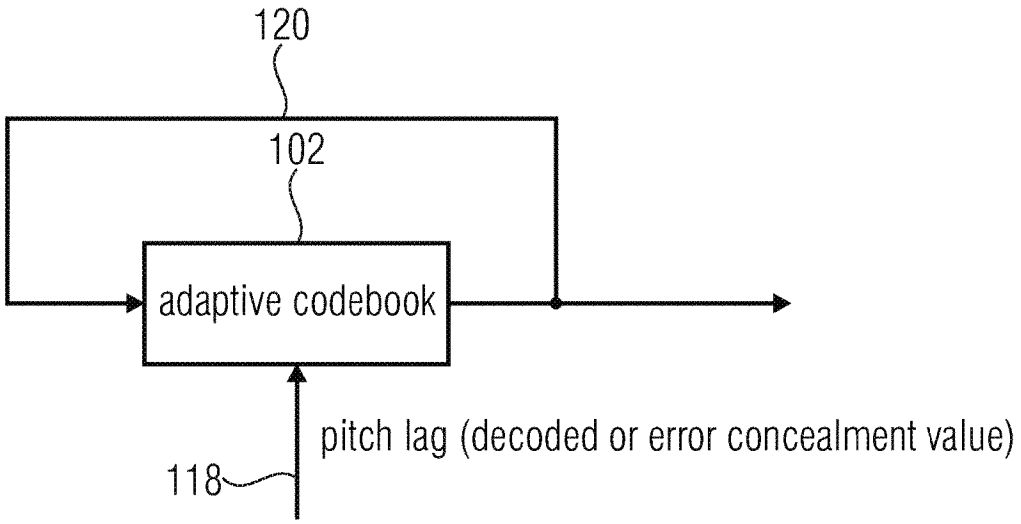
FIG. 1*b* illustrates a usage of an adaptive codebook.

FIG. 1*b* illustrates a representation of an adaptive codebook. The adaptive codebook is provided with a feedback loop 120 and receives, as an input, a pitch lag 118. The pitch lag can be a decoded pitch lag in the case of a good received frame/packet. However, if an error situation is detected indicating an erroneous or missing frame/packet, then an error concealment pitch lag 118 is provided by the decoder and input into the adaptive codebook. The adaptive codebook 102 can be implemented as a memory storing the fed back output values provided via the feedback line 120 and, depending on the applied pitch lag 118, a certain amount of sampling values is output by the adaptive codebook.

Figure 1C:
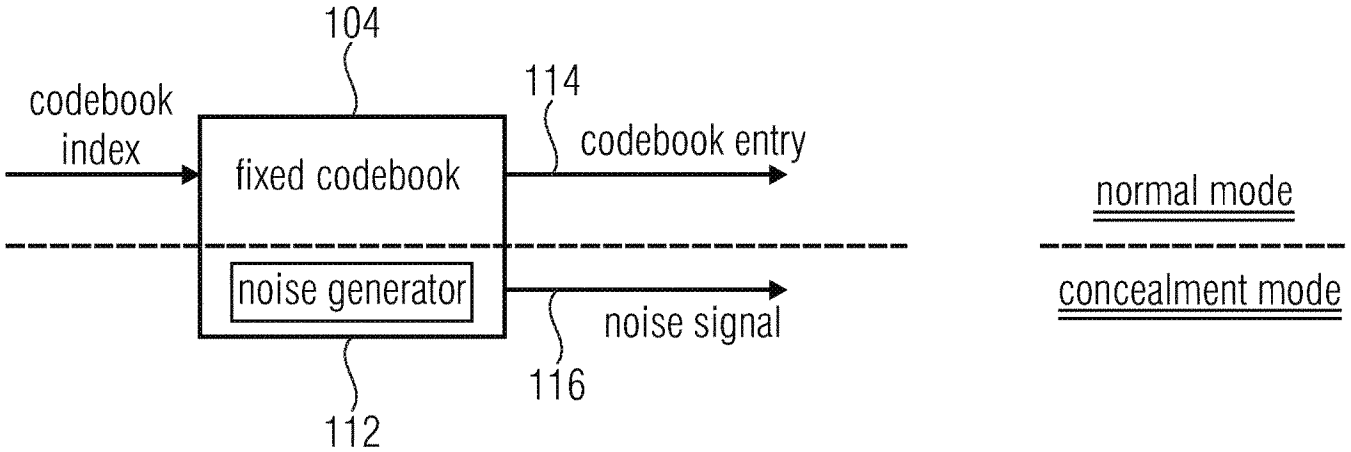
FIG. 1*c* illustrates a usage of a fixed codebook in the case of a normal mode or a concealment mode.

Furthermore, FIG. 1*c* illustrates a fixed codebook 104. In the case of the normal mode, the fixed codebook 104 receives a codebook index and, in response to the codebook index, a certain codebook entry 114 is provided by the fixed codebook as codebook information. However, if a concealment mode is determined, a codebook index is not available. Then, a noise generator 112 provided within the fixed codebook 104 is activated which provides a noise signal as the codebook information 116. Depending on the implementation, the noise generator may provide a random codebook index. However, it is advantageous that a noise generator actually provides a noise signal rather than a random codebook index. The noise generator 112 may be implemented as a certain hardware or software noise generator or can be implemented as noise tables or a certain "additional" entry in the fixed codebook which has a noise shape. Furthermore, combinations of the above procedures are possible, i.e. a noise codebook entry together with a certain post-processing.

Figure 1D:
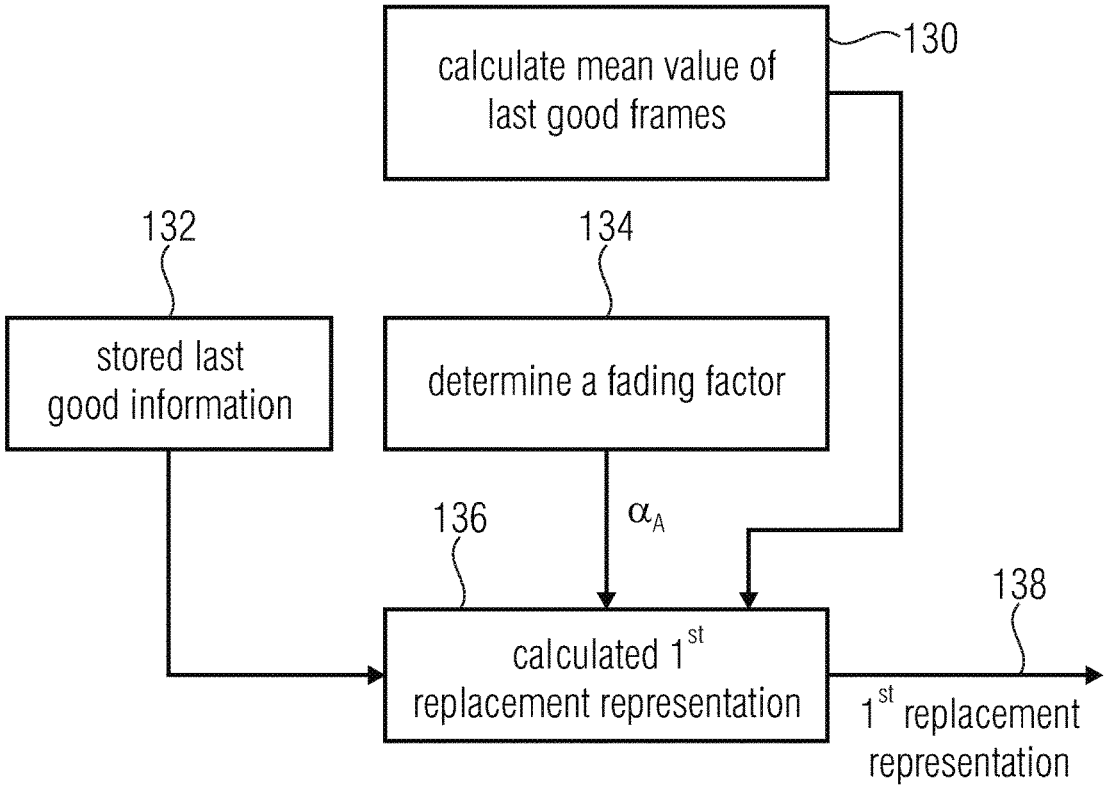
FIG. 1*d* illustrates a flowchart for calculating the first LPC replacement representation.

FIG. 1*d* illustrates a advantageous procedure for calculating a first replacement LPC representation in the case of an error. Step 130 illustrates the calculation of a mean value of LPC representations of two or more last good frames. Three last good frames are advantageous. Thus, a mean value over the three last good frames is calculated in block 130 and provided to block 136. Furthermore, a stored last good frame LPC information is provided in step 132 and additionally provided to the block 136. Furthermore, a fading factor 134 is determined in block 134. Then, depending on the last good LPC information, depending on the mean value of the LPC information of the last good frame and depending on the fading factor of block 134, the first replacement representation 138 is calculated.

For the state-of-the-art just one LPC is applied. For the newly proposed method, each excitation vector, which is generated by either the adaptive or the fixed codebook, is filtered by its own set of LPC coefficients. The derivation of the individual ISF vectors is as follows:

Coefficient set A (for filtering the adaptive codebook) is determined by this formula:

$$isf' = \frac{isf^{-2} + isf^{-3} + isf^{-4}}{3} \quad \text{(block 136)}$$

$$isf_A^{-1} = \text{alpha}_A \cdot isf^{-2} + (1 - \text{alpha}) \cdot isf' \quad \text{(block 136)}$$

where $\text{alpha}_A$ is a time varying adaptive fading factor which may depend on signal stability, signal class, etc. $isf^{-x}$ are the ISF coefficients, where x denotes the frame number, relative to the end of the current frame: x=−1 denotes the first lost ISF, x=−2 the last good, x=−3 second last good and so on.

This leads to fading the LPC which is used for filtering the tonal part, starting from the last correctly received frame towards the average LPC (averaged over three of the last good 20 ms frames). The more frames get lost, the closer the ISF, which is used during concealment, will be to this short term average ISF vector (isf').

Figure 1E:
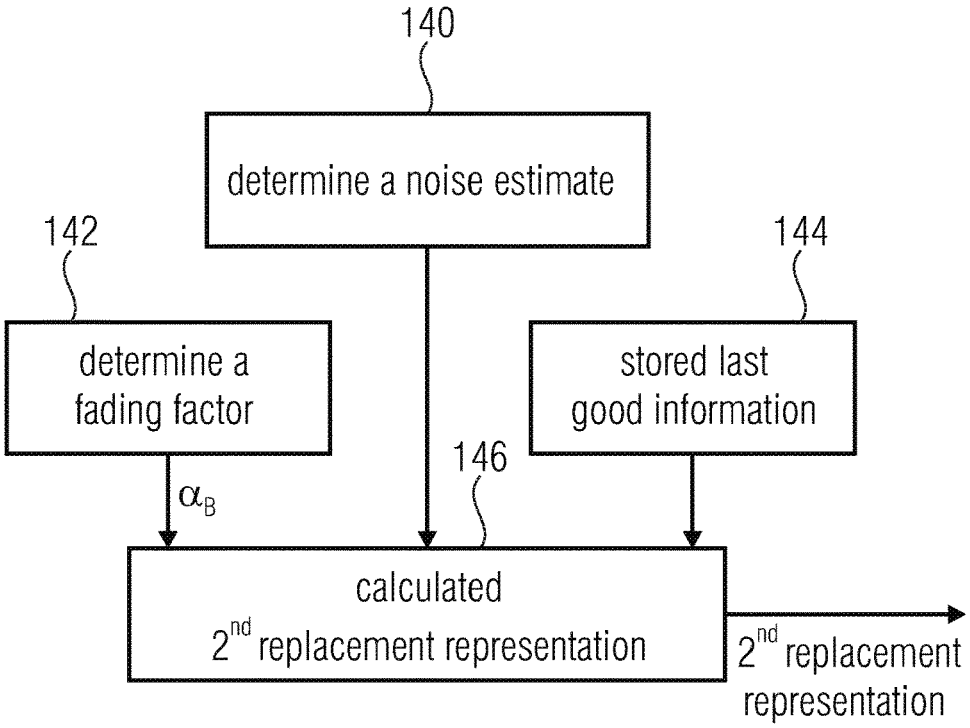
FIG. 1*e* illustrates a flowchart for calculating the second LPC replacement representation.

FIG. 1*e* illustrates a advantageous procedure for calculating the second replacement representation. In block 140, a noise estimate is determined. Then, in block 142, a fading factor is determined. Additionally, in block 144, the last good frame is LPC information which has been stored before is provided. Then, in block 146, a second replacement representation is calculated. Advantageously, a coefficient set B (for filtering the fixed codebook) is determined by this formula:

$$isf_B^{-1}=\text{alpha}_B \cdot isf^{-2}+(1-\text{beta}) \cdot isf^{eng} \quad \text{(block 146)}$$

where $isf^{eng}$ is the ISF coefficient set derived from a background noise estimate and $\text{alpha}_B$ is the time-varying fading speed factor which advantageously is signal dependent. The target spectral shape is derived by tracing the past decoded signal in the FFT domain (power spectrum), using a minimum statistics approach with optimal smoothing, similar to [3]. This FFT estimate is converted to the LPC representation by calculating the auto-correlation by doing inverse FFT and then using Levinson-Durbin recursion to calculate LPC coefficients using the first N samples of the inverse FFT, where N is the LPC order. This LPC is then converted into the ISF domain to retrieve $isf^{eng}$. Alternatively—if such tracing of the background spectral shape is not available—the target spectral shape might also be derived based on any combination of an offline trained vector and the short-term spectral mean, as it is done in G.718 for the common target spectral shape.

Advantageously, the fading factors A and $\alpha_B$ are determined depending on the decoded audio signal, i.e., depending on the decoded audio signal before the occurrence of an error. The fading factor may depend on signal stability, signal class, etc. Thus, is the signal is determined to be a quite noisy signal, then the fading factor is determined in such a way that the fading factor decreases, from time to time, more quickly than compared to a situation where a signal is quite tonal. In this situation, the fading factor decreases from one time frame to next time frame by a reduced amount. This makes sure that the fading out from the last good frame to the mean value of the last three good frames takes place more quickly in the case of noisy signals compared to non-noisy or tonal signals, where the fading out speed is reduced. Similar procedures can be performed for signal classes. For voiced signals, a fading out can be performed slower than for unvoiced signals or for music signals a certain fading speed can be reduced compared to further signal characteristics and corresponding determinations of the fading factor can be applied.

As discussed in the context of FIG. 1*e*, a different fading factor $\alpha_B$ can be calculated for the second codebook information. Thus, the different codebook entries can be provided with a different fading speed. Thus, a fading out to the noise estimate as $f^{eng}$ can be set differently from the fading speed from the last good frame ISF representation to the mean ISF representation as outlined in block 136 of FIG. 1*d*.

Figure 2:
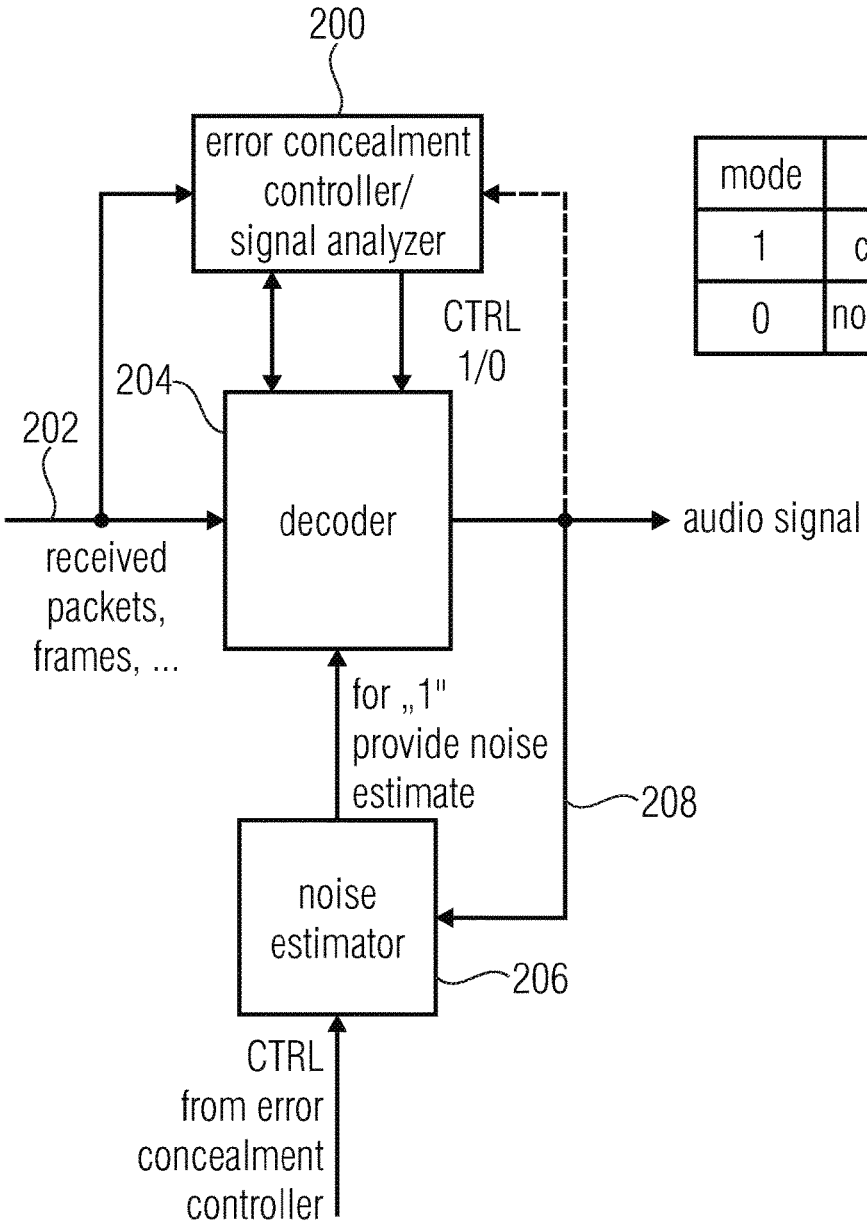
FIG. 2 illustrates an overview over a decoder with error concealment controller and noise estimator.

FIG. 2 illustrates an overview of a advantageous implementation. An input line receives, for example, from a wireless input interface or a cable interface packets or frames of an audio signal. The data on the input line 202 is provided to a decoder 204 and at the same time to an error concealment controller 200. The error concealment controller determines whether received packet or frames are erroneous or missing. If this is determined, the error concealment controller inputs a control message to the decoder 204. In the FIG. 2 implementation, a "1" message on the control line CTRL signals that the decoder 204 is to operate in the concealment mode. However, if the error concealment controller does not find an error situation, then the control line CTRL carries a "0" message indicating a normal decoding mode as indicated in table 210 of FIG. 2. The decoder 204 is additionally connected to a noise estimator 206. During the normal decoding mode, the noise estimator 206 receives the decoded audio signal via a feedback line 208 and determines a noise estimate from the decoded signal. However, when the error concealment controller indicates a change from the normal decoding mode to the concealment mode, the noise estimator 206 provides the noise estimate to the decoder 204 so that the decoder 204 can perform an error concealment as discussed in the preceding and the next figures. Thus, the noise estimator 206 is additionally controlled by the control line CTRL from the error concealment controller to switch, from the normal noise estimation mode in the normal decoding mode to the noise estimate provision operation in the concealment mode.

Figure 4:
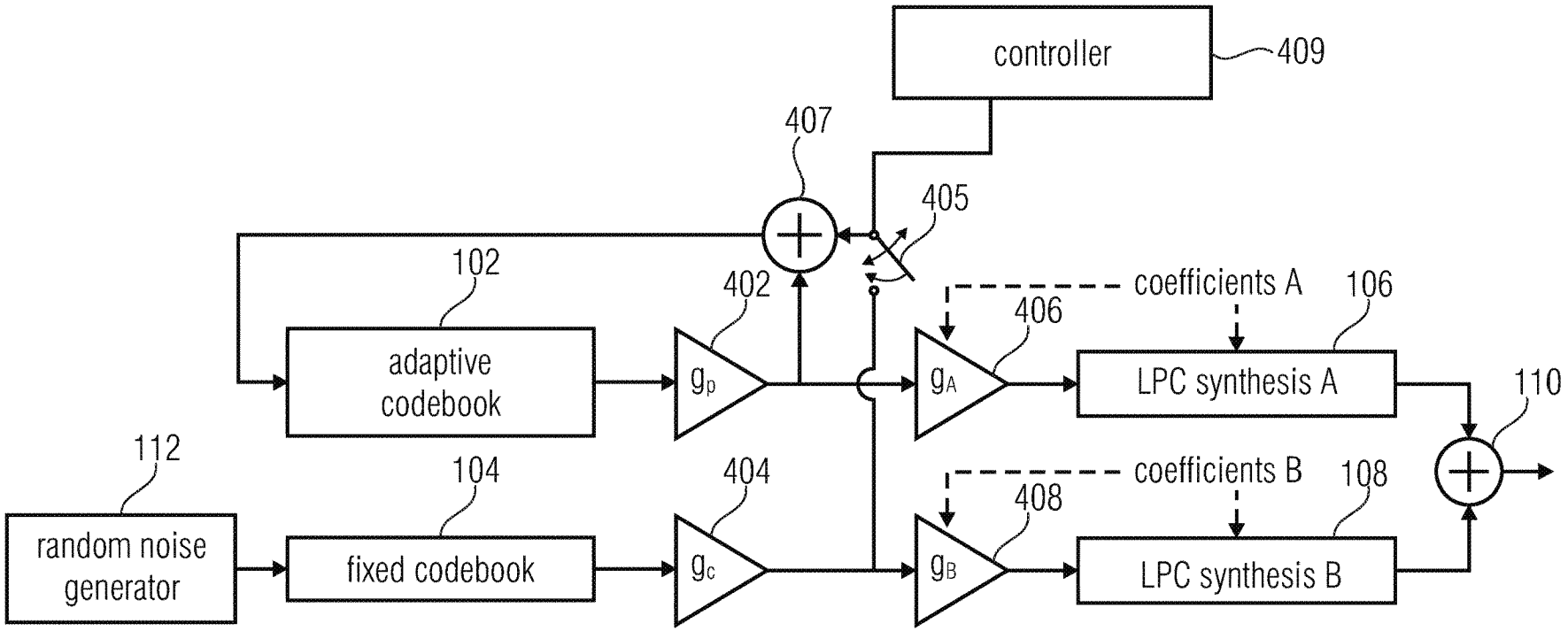
FIG. 4 illustrates a advantageous embodiment combining the first aspect and the second aspect.
Figure 8:
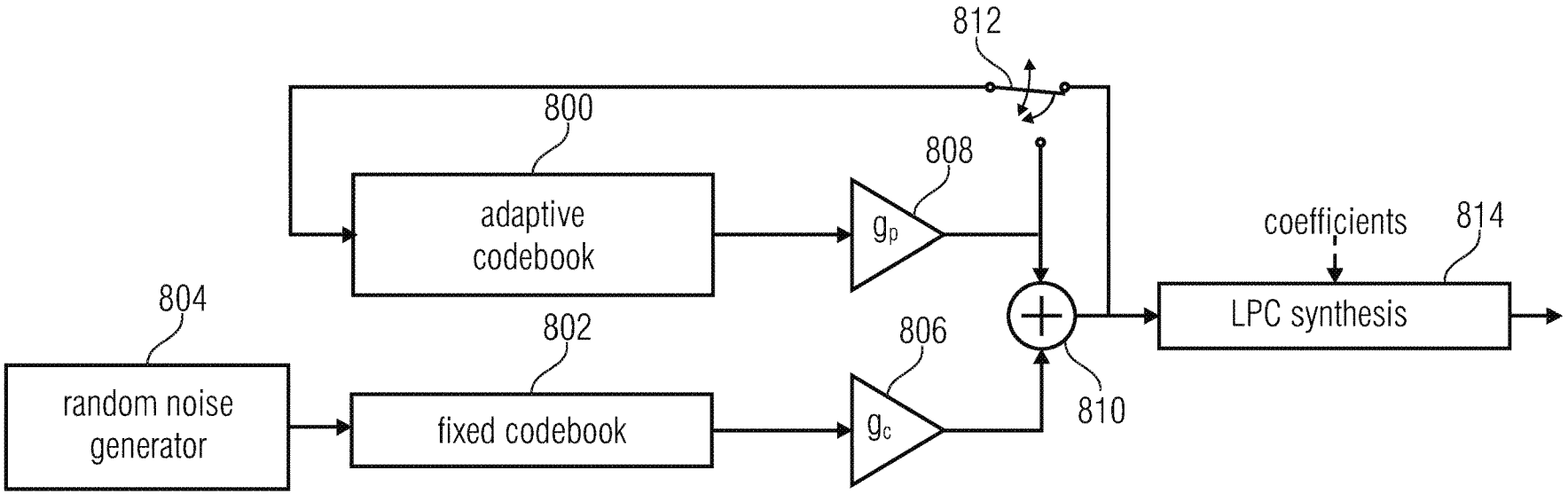
FIG 8 (PRIOR ART)
FIG. 8 illustrates a conventional-technology error concealment signal generator.

FIG. 4 illustrates a advantageous embodiment of the present invention in the context of a decoder, such as the decoder 204 of FIG. 2, having an adaptive codebook 102 and additionally having a fixed codebook 104. In the normal decoding mode indicated by a control line data "0" as discussed in the context of the table 210 in FIG. 2, the decoder operates as illustrated in FIG. 8, when item 804 is neglected. Thus, the correctly received packet comprises a fixed codebook index for controlling the fixed codebook 802, a fixed codebook gain $g_c$ for controlling amplifier 806 and an adaptive codebook $g_p$ in order to control the amplifier 808. Furthermore, the adaptive codebook 800 is controlled by the transmitted pitch lag and the switch 812 is connected so that the adaptive codebook output is fed back into the input of the adaptive codebook. Furthermore, the coefficients for the LPC synthesis filter 804 are derived from the transmitted data.

However, if an error concealment situation is detected by the error concealment controller 202 of FIG. 2, the error concealment procedure is initiated in which, in contrast to the normal procedure, two synthesis filters 106, 108 are provided. Furthermore, the pitch lag for the adaptive codebook 102 is generated by an error concealment device. Additionally, the adaptive codebook gain $g_p$ and the fixed codebook gain $g_c$ are also synthesized by an error concealment procedure as known in the art in order to correctly control the amplifiers 402, 404.

Furthermore, depending on the signal class, a controller 409 controls the switch 405 in order to either feedback a combination of both codebook outputs (subsequent to the application of the corresponding codebook gain) or to only feedback the adaptive codebook output.

In accordance with an embodiment, the data for the LPC synthesis filter A 106 and the data for the LPC synthesis filter B 108 is generated by the LPC representation generator 100 of FIG. 1*a* and additionally a gain correction is performed by the amplifiers 406, 408. To this end, the gain compensation factors $g_A$ and $g_B$ are calculated in order to correctly drive the amplifiers 408, 406 so that any gain influence generated by the LPC representation is stopped. Finally, the output of the LPC synthesis filters A, B indicated by 106 and 108 are combined by the combiner 110, so that the error concealment signal is obtained.

Subsequently, the switching from the normal mode to the concealment mode on one hand and from the concealment mode back to the normal mode is discussed.

The transition from one common to several separate LPCs when switching from clean channel decoding to concealment does not cause any discontinuities, as the memory state of the last good LPC may be used to initialize each AR or MA memory of the separate LPCs. When doing so, a smooth transition from the last good to the first lost frame is ensured.

Figure 5:
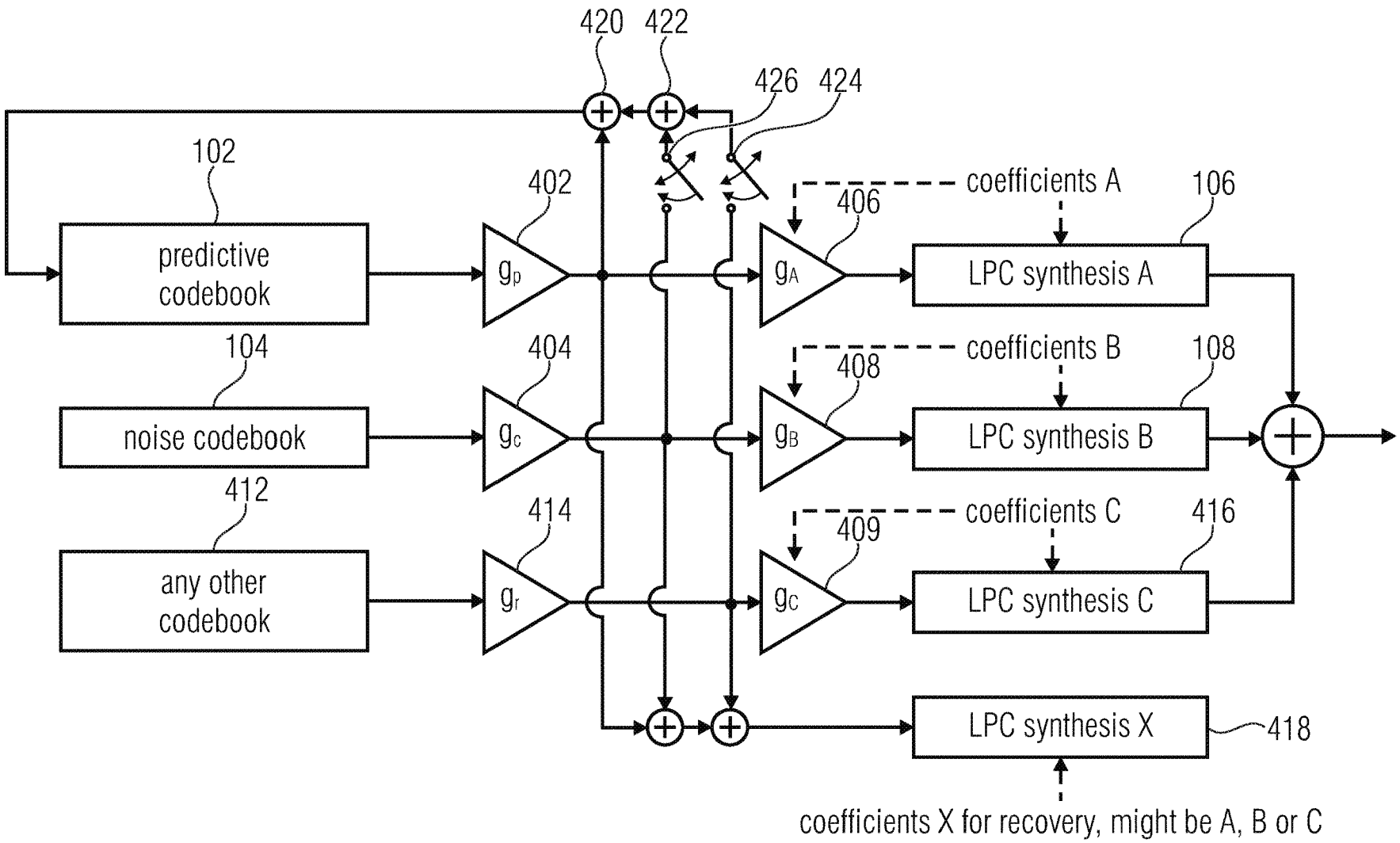
FIG. 5 illustrates a further embodiment combining the first and second aspects.

When switching from concealment to clean channel decoding (recovery phase), the approach of the separate LPCs introduces the challenge to correctly update the internal memory state of the single LPC filter during clean-channel decoding (usually AR (auto-regressive) models are used). Just using the AR memory of one LPC or an averaged AR memory would lead to discontinuities at the frame border between the last lost and the first good frame. In the following a method is described to overcome deal with this challenge:

A small portion of all excitation vectors (suggestion: 5 ms) is added at the end of any concealed frame. This summed excitation vector may then be fed to the LPC which would be used for recovery. This is shown in FIG. 5. Depending on the implementation it is also possible to sum up the excitation vectors after the LPC gain compensation.

It is advisable to start at frame end minus 5 ms, setting the LPC AR memory to zero, derive the LPC synthesis by using any of the individual LPC coefficient sets and save the memory state at the very end of the concealed frame. If the next frame is correctly received, this memory state may then be used for recovery (meaning: used for initializing the start-of-frame LPC memory), otherwise it is discarded. This memory has to be additionally introduced; it is to be handled separately from any of the used LPC AR memories of the concealment used during concealment.

Another solution for recovery is to use the method LPC0, known from USAC [4].

Subsequently, FIG. 5 is discussed in more detail. Generally, the adaptive codebook 102 can be termed to be a predictive codebook as indicated in FIG. 5 or can be replaced by a predictive codebook. Furthermore, the fixed codebook 104 can be replaced or implemented as the noise codebook 104. The codebook gains $g_p$ and $g_c$, in order to correctly drive the amplifiers 402,404 are transmitted, in the normal mode, in the input data or can be synthesized by an error concealment procedure in the error concealment case. Furthermore, a third codebook 412, which can be any other codebook, is used which additionally has an associated codebook gain $g_r$ as indicated by amplifier 414. In an embodiment, an additional LPC synthesis by a separate filter controlled by an LPC replacement representation for the other codebook is implemented in block 416. Furthermore, a gain correction $g_c$ is performed in a similar way as discussed in the context of $g_A$ and $g_B$, as outlined.

Furthermore, the additional recovery LPC synthesizer X indicated at 418 is shown which receives, as an input, a sum of at least a small portion of all excitation vectors such as 5 ms.

This excitation vector is input into the LPC synthesizer X 418 memory states of the LPC synthesis filter X.

Then, when a switchback from the concealment mode to the normal mode occurs, the single LPC synthesis filter is controlled by copying the internal memory states of the LPC synthesis filter X into this single normal operating filter and additionally the coefficients of the filter are set by the correctly transmitted LPC representation.

Figure 3:
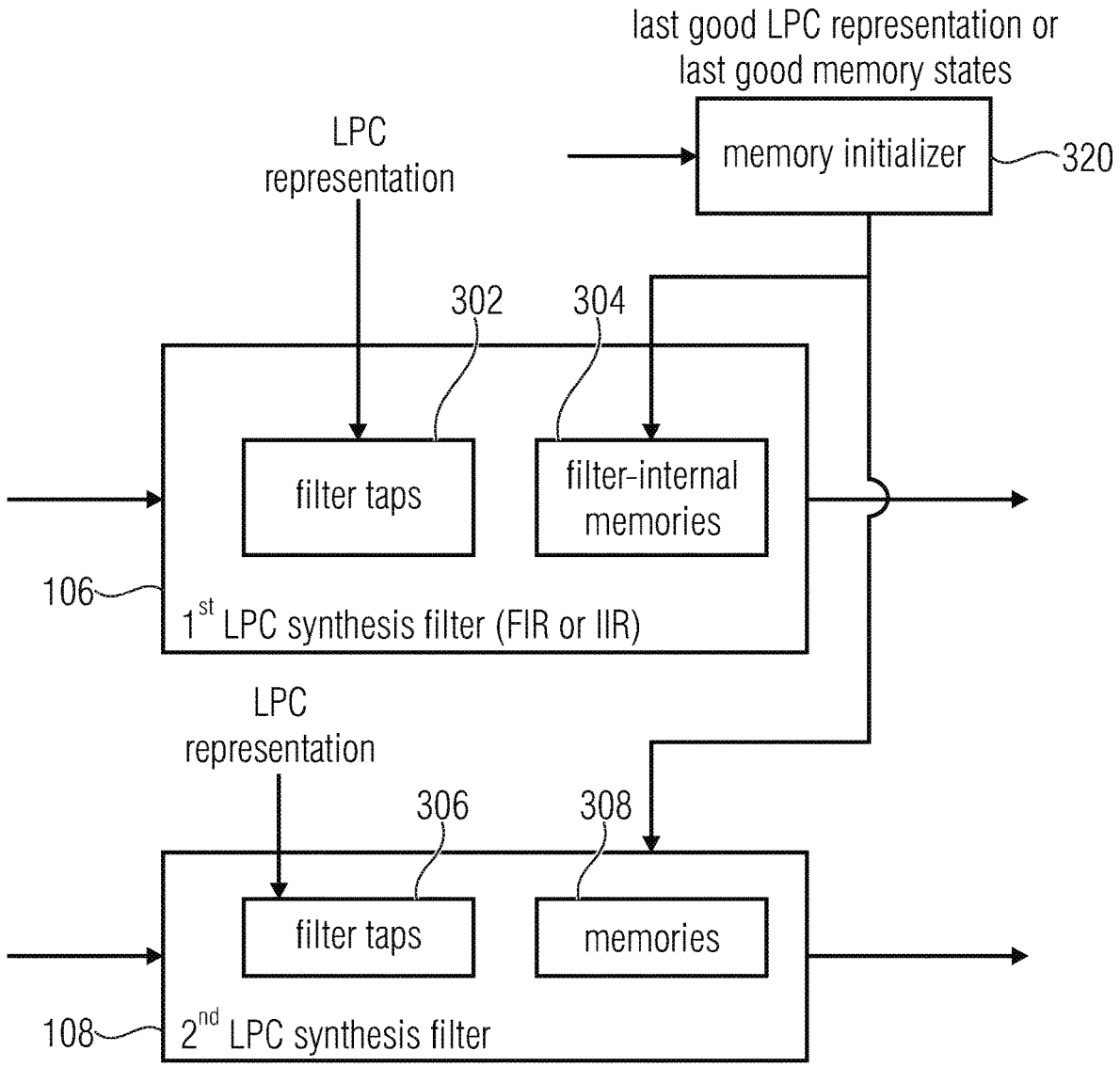
FIG. 3 illustrates a detailed representation of the synthesis filters.

FIG. 3 illustrates a further, more detailed implementation of the LPC synthesizer having two LPC synthesis filters 106, 108. Each filter is, for example, an FIR filter or an IIR filter having filter taps 304, 306 and filter-internal memories 304, 308. The filter taps 302, 306 are controlled by the corresponding LPC representation correctly transmitted or the corresponding replacement LPC representation generated by the LPC representation generator such as 100 of FIG. 1*a*. Furthermore, a memory initializer 320 is provided. The memory initializer 320 receives the last good LPC representation and, when switch over to the error concealment mode is performed, the memory initializer 320 provides the memory states of the single LPC synthesis filter to the filter-internal memories 304, 308. In particular, the memory initializer receives, instead of the last good LPC representation or in addition to the last good LPC representation, the last good memory states, i.e. the internal memory states of the single LPC filter in the processing, and particularly after the processing of the last good frame/packet.

Additionally, as already discussed in the context of FIG. 5, the memory initializer 320 can also be configured to perform the memory initialization procedure for a recovery from an error concealment situation to the normal non-erroneous operating mode. To this end, the memory initializer 320 or a separate future LPC memory initializer is configured for initializing a single LPC filter in the case of a recovery from an erroneous or lost frame to a good frame. The LPC memory initializer is configured for feeding at least a portion of a combined first codebook information and second codebook information or at least a portion of a combined weighted first codebook information or a weighted second codebook information into a separate LPC filter such as LPC filter 418 of FIG. 5. Additionally, the LPC memory initializer is configured for saving memory states obtained by processing the fed in values. Then, when a subsequent frame or packet is a good frame or packet, the single LPC filter 814 of FIG. 8 for the normal mode is initialized using the saved memory states, i.e. the states from filter 418. Furthermore, as outlined in FIG. 5, the filter coefficients for the filter can be either the coefficient for LPC synthesis filter 106 or LPC synthesis filter 108 or LPC synthesis filter 416 or a weighted or unweighted combination of those coefficients.

Figure 6:
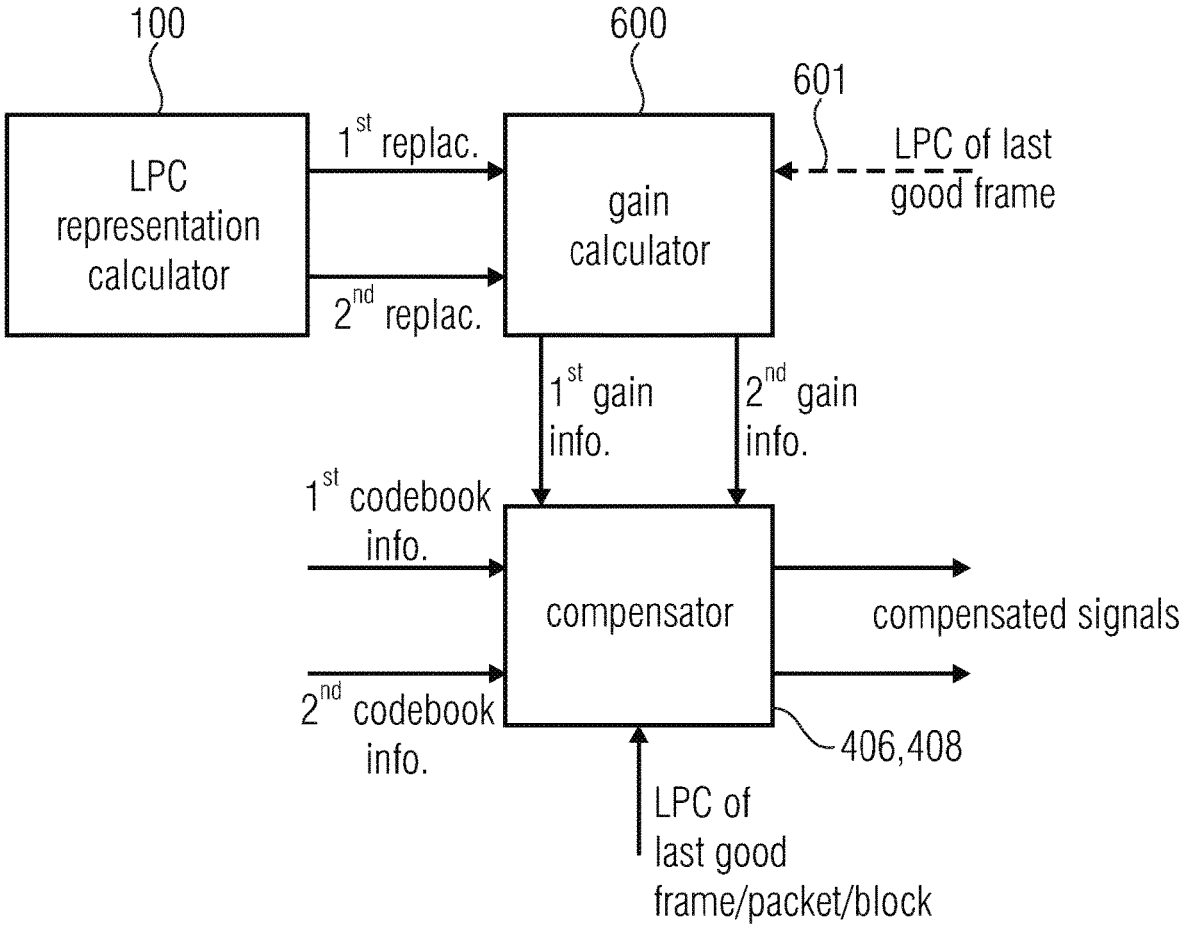
FIG. 6 illustrates the embodiment combining the first and second aspects.

FIG. 6 illustrates a further implementation with gain compensation. To this end, the apparatus for generating an error concealment signal comprises a gain calculator 600 and a compensator 406, 408, which has already been discussed in the context of FIG. 4 (406, 408) and FIG. 5 (406, 408, 409). In particular, the LPC representation calculator 100 outputs the first replacement LPC representation and the second replacement LPC representation to a gain calculator 600. The gain calculator then calculates a first gain information for the first replacement LPC representation and the second gain information for the second LPC replacement representation and provides this data to the compensator 406, 408, which receives, in addition to the first and second codebook information, as outlined in FIG. 4 or FIG. 5, the LPC of the last good frame/packet/block. Then, the compensator outputs the compensated signal. The input into the compensator can either be an output of amplifiers 402, 404, an output of the codebooks 102, 104 or an output of the synthesis blocks 106, 108 in the embodiment of FIG. 4.

Compensator 406, 408 partly or fully compensates a gain influence of the first replacement LPC in the first gain information and compensates a gain influence of the second replacement LPC representation using the second gain information.

In an embodiment, the calculator 600 is configured to calculate a last good power information related to a last good LPC representation before a start of the error concealment. Furthermore, the gain calculator 600 calculates a first power information for the first replacement LPC representation, a second power information for the second LPC representation, the first gain value using the last good power information and the first power information, and a second gain value using the last good power information and the second power information. Then, the compensation is performed in the compensator 406, 408 using the first gain value and using the second gain value. Depending on the information, however, the calculation of the last good power information can also be performed, as illustrated in the FIG. 6 embodiment, by the compensator directly. However, due to the fact that the calculation of the last good power information is basically performed in the same way as the first gain value for the first replacement representation and the second gain value for the second replacement LPC representation, it is advantageous to perform the calculation of all gain values in the gain calculator 600 as illustrated by the input 601.

In particular, the gain calculator 600 is configured to calculate from the last good LPC representation or the first and second LPC replacement representations an impulse response and to then calculate an rms (root mean square) value from the impulse response to obtain the correspondent power information in the gain compensation, each excitation vector is—after being gained by the corresponding codebook gain—again amplified by the gains: $g_A$ or $g_B$. These gains are determined by calculating the impulse response of the currently used LPC and then calculating the rms:

$$\mathrm{rms}_{new} = \sqrt{\sum_{t=0ms}^{5ms} \mathrm{imp_resp}^2(t)}$$

The result is then compared to the rms of the last correctly received LPC and the quotient is used as gain factor in order to compensate for energy increase/loss of LPC interpolation:

$$g = \frac{\mathrm{rms}_{old}}{\mathrm{rms}_{new}}$$

This procedure can be seen as a kind of normalization. It compensates the gain, which is caused by LPC interpolation.

Figure 7A:
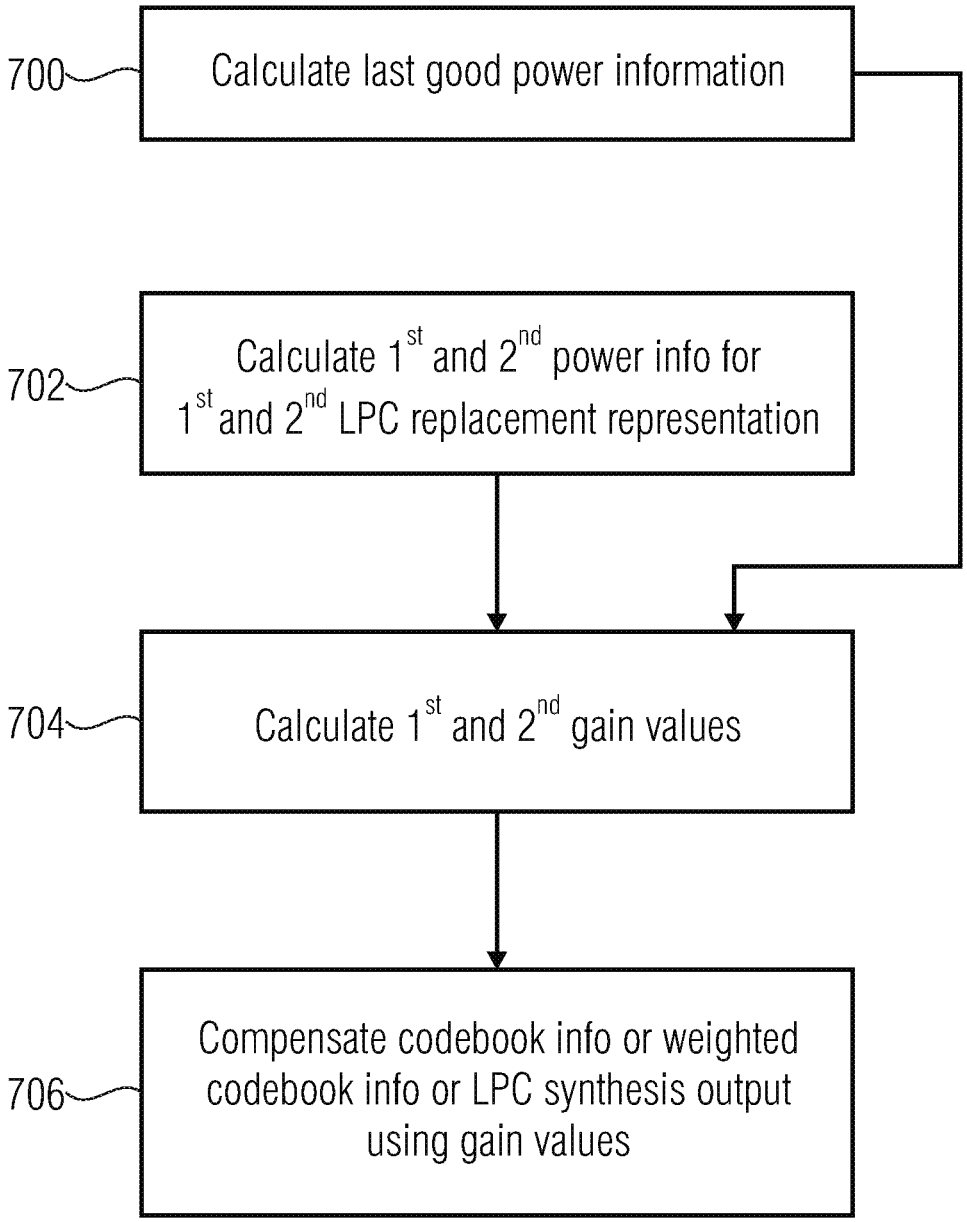
FIG. 7*a* illustrates an embodiment for performing a gain compensation.
Figure 7B:
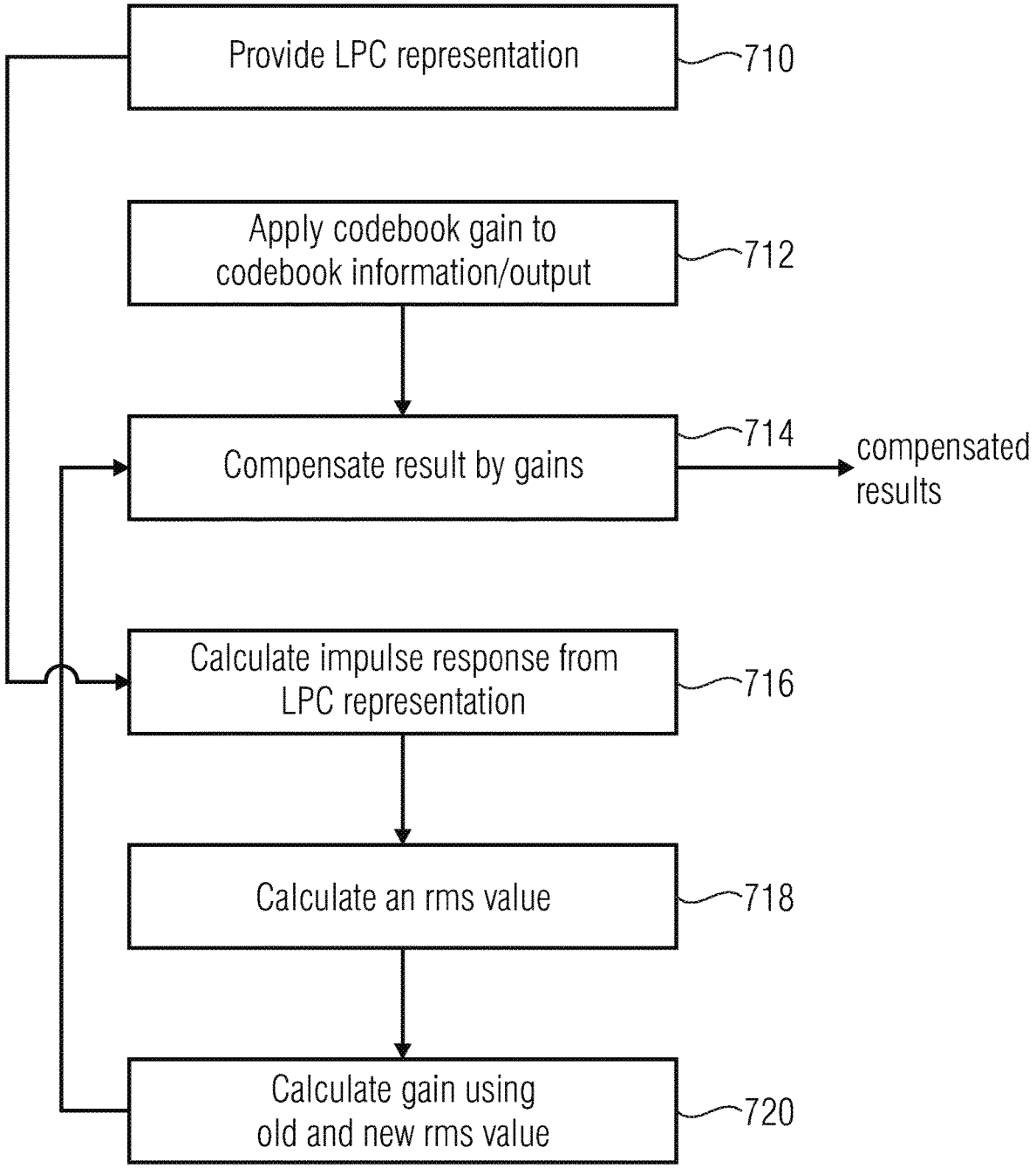
FIG. 7*b* illustrates a flowchart for performing a gain compensation.

Subsequently, FIGS. 7*a* and 7*b* are discussed in more detail to illustrate the apparatus for generating an error concealment signal or the gain calculator 600 or the compensator 406, 408 calculates the last good power information as indicated at 700 in FIG. 7*a*. Furthermore, the gain calculator 600 calculates the first and second power information for the first and second LPC replacement representation as indicated at 702. Then, as illustrated by 704, the first and the second gain values are calculated advantageously by the gain calculator 600. Then, the codebook information or the weighted codebook information or the LPC synthesis output is compensated using these gain values as illustrated at 706. This compensation is advantageously done by the amplifiers 406, 408.

To this end, several steps are performed in an advantageous embodiment as illustrated in FIG. 7*b*. In step 710, an LPC representation, such as the first or second replacement LPC representation or the last good LPC representation is provided. In step 712 the codebook gains are applied to the codebook information/output as indicated by block 402, 404. Furthermore, in step 716, impulse responses are calculated from the corresponding LPC representations. Then, in step 718, an rms value is calculated for each impulse response and in block 720 the corresponding gain is calculated using an old rms value and a new rms value and this calculation is advantageously done by dividing the old rms value by the new rms value. Finally, the result of block 720 is used to compensate the result of step 712 in order to finally obtained the compensated results as indicated at step 714.

Figure 9:
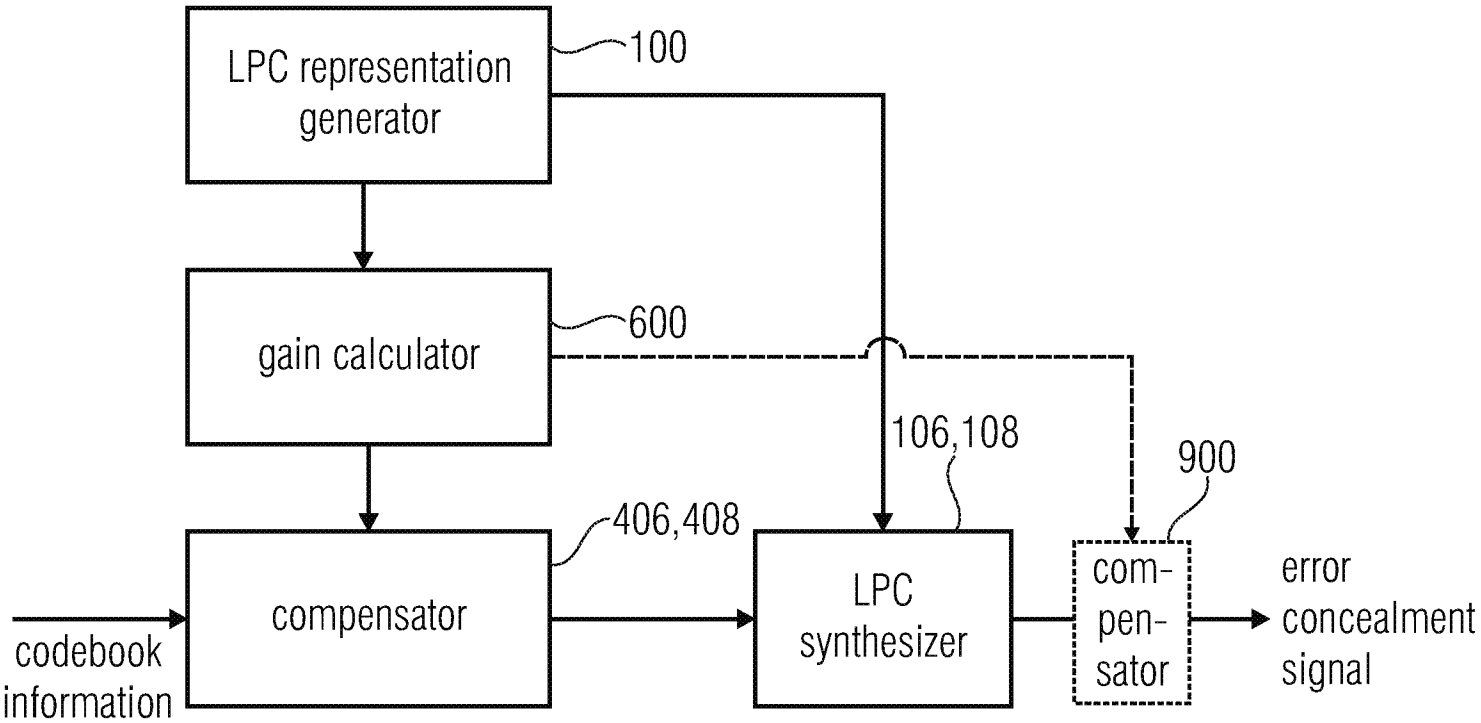
FIG. 9 illustrates an embodiment in accordance with the second aspect with gain compensation.

Subsequently, a further aspect is discussed, i.e. an implementation for an apparatus for generating an error concealment signal which ha the LPC representation generator 100 generating only a single replacement LPC representation, such as for the situation illustrated in FIG. 8. In contrast to FIG. 8, however, the embodiment illustrating a further aspect in FIG. 9 comprises the gain calculator 600 and the compensator 406, 408. Thus, any gain influence by the replacement LPC representation generated by the LPC representation generator is compensated for. In particular, this gain compensation can be performed on the input side of the LPC synthesizer as illustrated in FIG. 9 by compensator 406, 408*n* or can be alternatively performed to the output of the LPC synthesizer as illustrated by the compensator 900 in order to finally obtain the error concealment signal. Thus, the compensator 406, 408, 900 is configured for weighting the codebook information or an LPC synthesis output signal provided by the LPC synthesizer 106, 108.

The other procedures for the LPC representation generator, the gain calculator, the compensator and the LPC synthesizer can be performed in the same way as discussed in the context of FIGS. 1*a* to 8.

Figure 10:
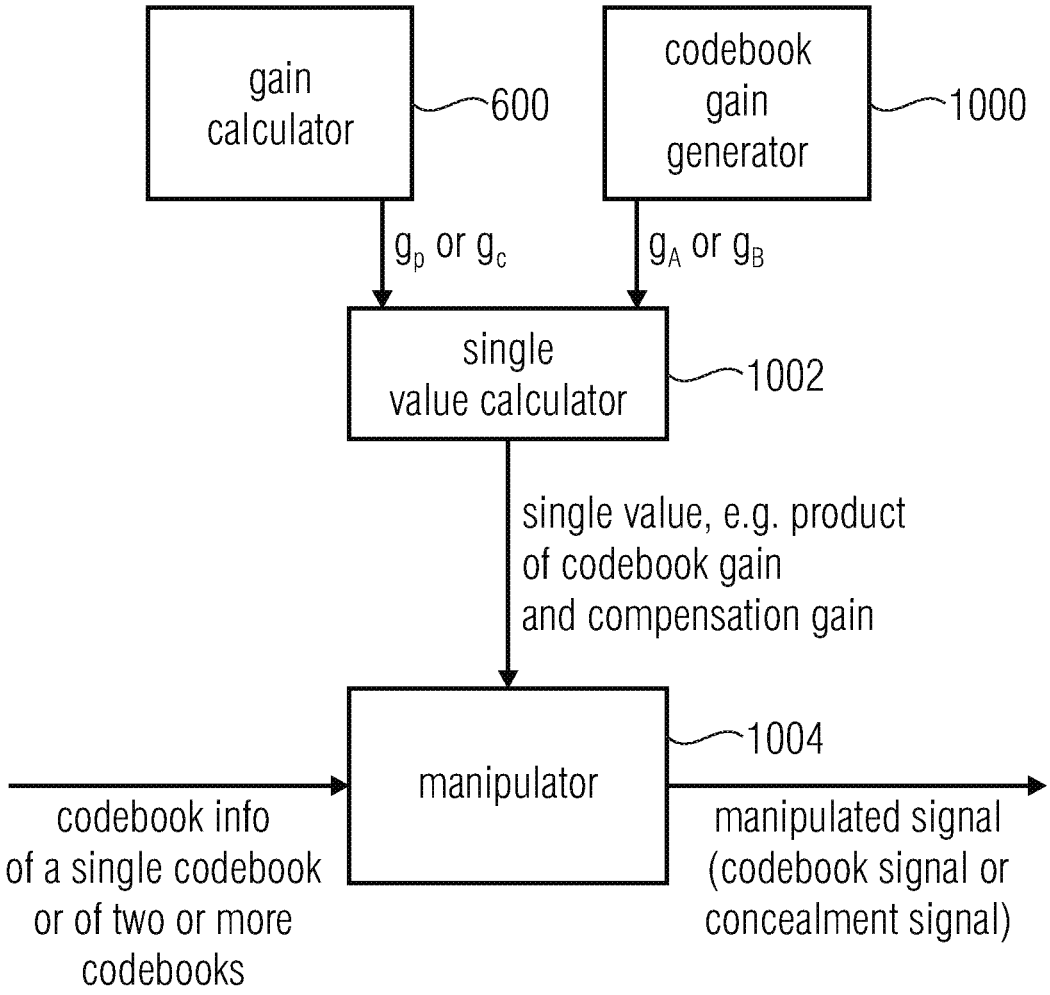
FIG. 10 illustrates a further implementation of the embodiment of FIG. 9.

As has been outlined in the context of FIG. 4, the amplifier 402 and the amplifier 406 perform two weighting operations in series to each other, particularly in the case where not the sum of the multiplier output 402, 404 is fed back into the adaptive codebook, but where only the adaptive codebook output is fed back, i.e. when the switch 405 is in the illustrated position or the amplifier 404 and the amplifier 408 perform two weighting operations in series. In an embodiment, illustrated in FIG. 10, these two weighting operations can be performed in a single operation. To this end, the gain calculator 600 provides its output $g_p$ or $g_c$ to a single value calculator 1002. Furthermore, a codebook gain generator 1000 is implemented in order to generate a concealment codebook gain as known in the art. The single value calculator 1002 then advantageously calculators a product between $g_p$ and $g_A$ in order to obtain the single value. Furthermore, for the second branch, the single value calculator 1002 calculates a product between $g_A$ or $g_B$ in order to provide the single value for the lower branch in FIG. 4. A further procedure can be performed for the third branch having amplifiers 414, 409 of FIG. 5.

Figure 11:
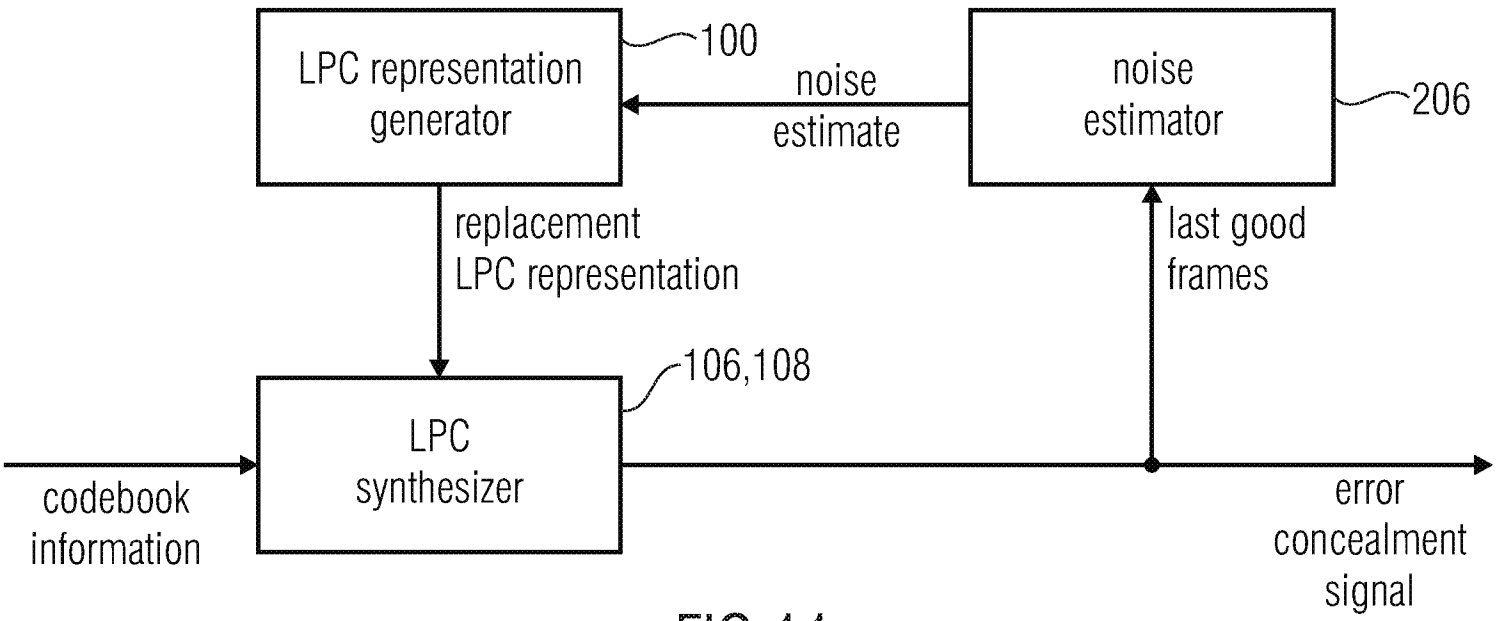
FIG. 11 illustrates an embodiment of the third aspect using the noise estimator.

Then a manipulator 1004 is provided which together performs the operations of for example amplifiers 402, 406 to the codebook information of a single codebook or to the codebook information of two or more codebooks in order to finally obtain a manipulated signal such as a codebook signal or a concealment signal, depending on whether the manipulator 1004 is located before the LPC synthesizer in FIG. 9 or subsequent to the LPC synthesizer of FIG. 9. FIG. 11 illustrates a third aspect, in which the LPC representation generator 100, the LPC synthesizer 106, 108 and the additional noise estimator 206, which has already been discussed in the context of FIG. 2, are provided. The LPC synthesizer 106, 108 receives codebook information and a replacement LPC representation. The LPC representation is generated by the LPC representation generator using the noise estimate from the noise estimator 206, and the noise estimator 206 operates by determining the noise estimate from the last good frames. Thus, the noise estimate depends on the last good audio frames and the noise estimate is estimated during a reception of good audio frames, i.e. in the normal decoding mode indicated by "0" on the control line of FIG. 2 and this noise estimate generated during the normal decoding mode is then applied in the concealment mode as illustrated by the connection of blocks 206 and 204 in FIG. 2.

The noise estimator is configured to process a spectral representation of a past decoded signal to provide a noise spectral representation and to convert the noise spectral representation into a noise LPC representation, where the noise LPC representation is the same kind of an LPC representation as the replacement LPC representation. Thus, when the replacement LPC representation is in the ISF-domain representation or an ISF vector, then the noise LPC representation additionally is an ISF vector or ISF representation.

Furthermore, the noise estimator 206 is configured to apply a minimum statistics approach with optimal smoothing to a past decoded signal to derive the noise estimate. For this procedure, it is advantageous to perform the procedure illustrated in [3]. However, other noise estimation procedures relying on, for example, suppression of tonal parts compared to non-tonal parts in a spectrum in order to filter out the background noise or noise in an audio signal can be applied as well for obtaining the target spectral shape or noise spectral estimate.

Thus, in one embodiment, a spectral noise estimate is derived from a past decoded signal and the spectral noise estimate is then converted into an LPC representation and then into an ISF domain to obtain the final noise estimate or target spectral shape.

Figure 12A:
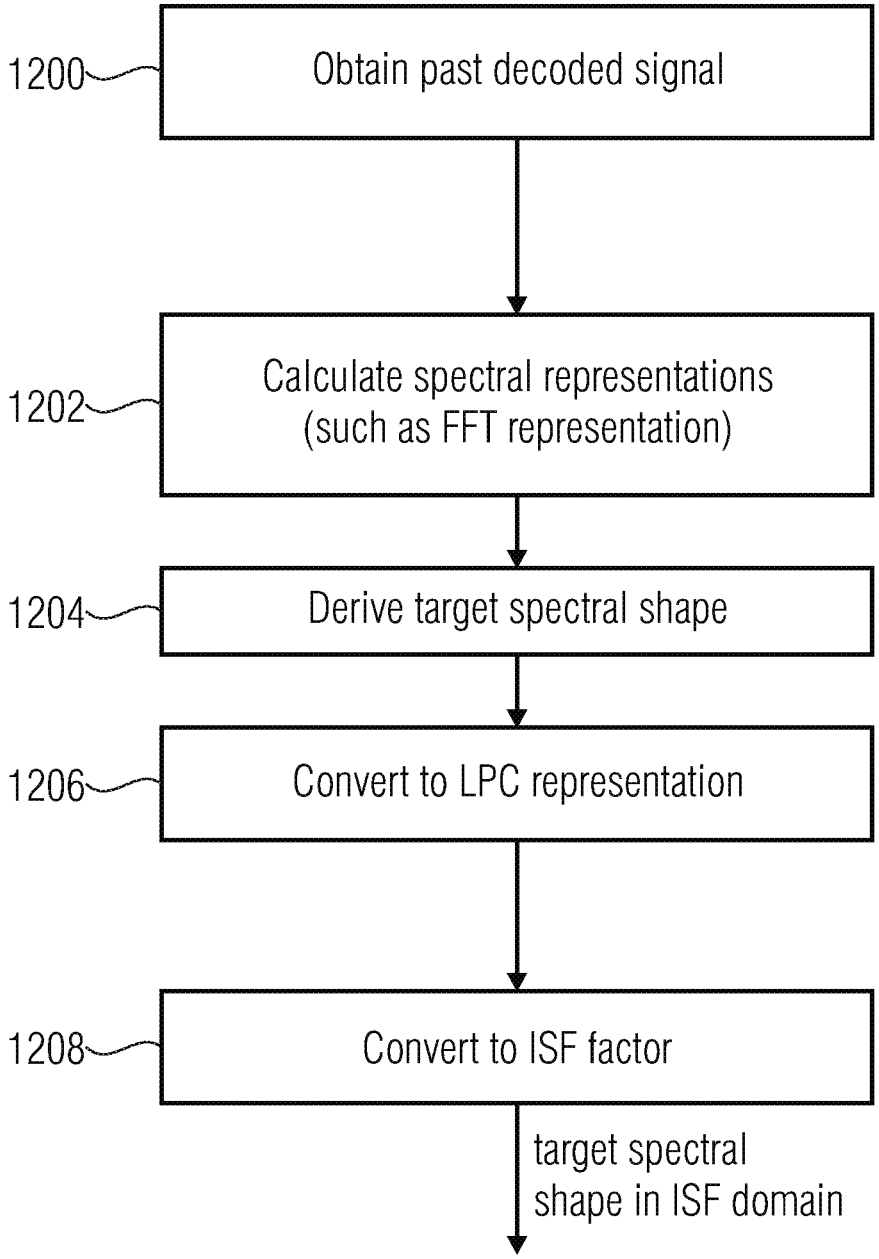
FIG. 12*a* illustrates a advantageous implementation for calculating the noise estimate.

FIG. 12*a* illustrates a advantageous embodiment. In step 1200, the past decoded signal is obtained, as for example illustrated in FIG. 2 by the feedback loop 208. In step 1202, a spectral representation, such as a Fast Fourier transform (FFT) representation is calculated. Then, in step 1204 a target spectral shape is derived such as by the minimum statistics approach with optimal smoothing or by any other noise estimator processing. Then, the target spectral shape is converted into an LPC representation as indicated by block 1206 and finally the LPC representation is converted to an ISF factor as outlined by block 1208 in order to finally obtain the target spectral shape in the ISF domain which can then be directly used by the LPC representation generator for generating a replacement LPC representation. In the equations of this application, the target spectral shape in the ISF domain is indicated as "$ISF^{cng}$".

Figure 12B:
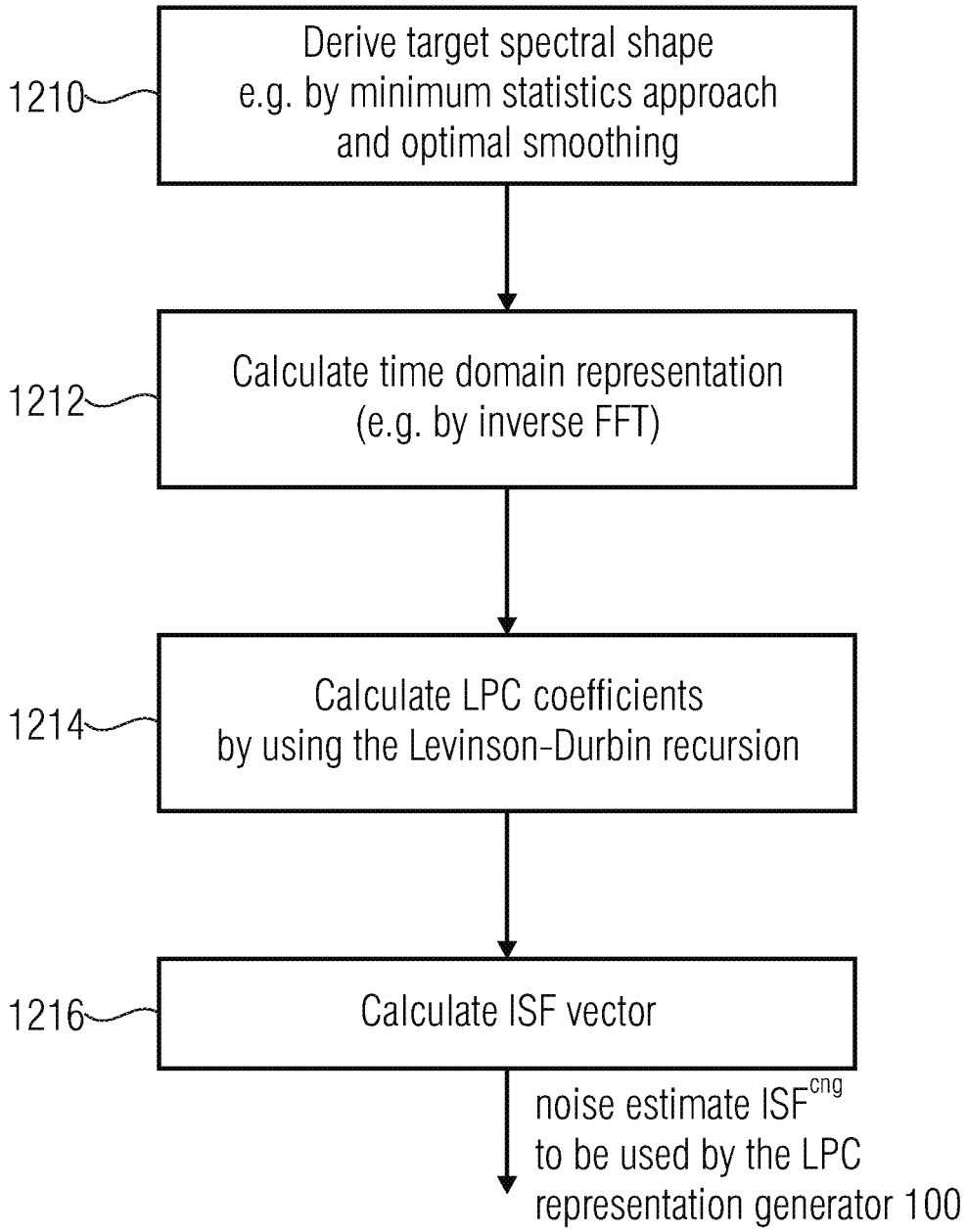
FIG. 12*b* illustrates a further advantageous implementation for calculating the noise estimate.

In a advantageous embodiment illustrated in FIG. 12*b*, the target spectral shape is derived for example by a minimum statistics approach and optimal smoothing. Then, in step 1212, a time domain representation is calculated by applying an inverse FFT, for example, to the target spectral shape. Then, LPC coefficients are calculated by using Levinson-Durbin recursion. However, the LPC coefficients calculation of block 1214 can also be performed by any other procedure apart from the mentioned Levinson-Durbin recursion. Then, in step 1216, the final ISF factor is calculated to obtain the noise estimate $ISF^{cng}$ to be used by the LPC representation generator 100.

Figure 13:
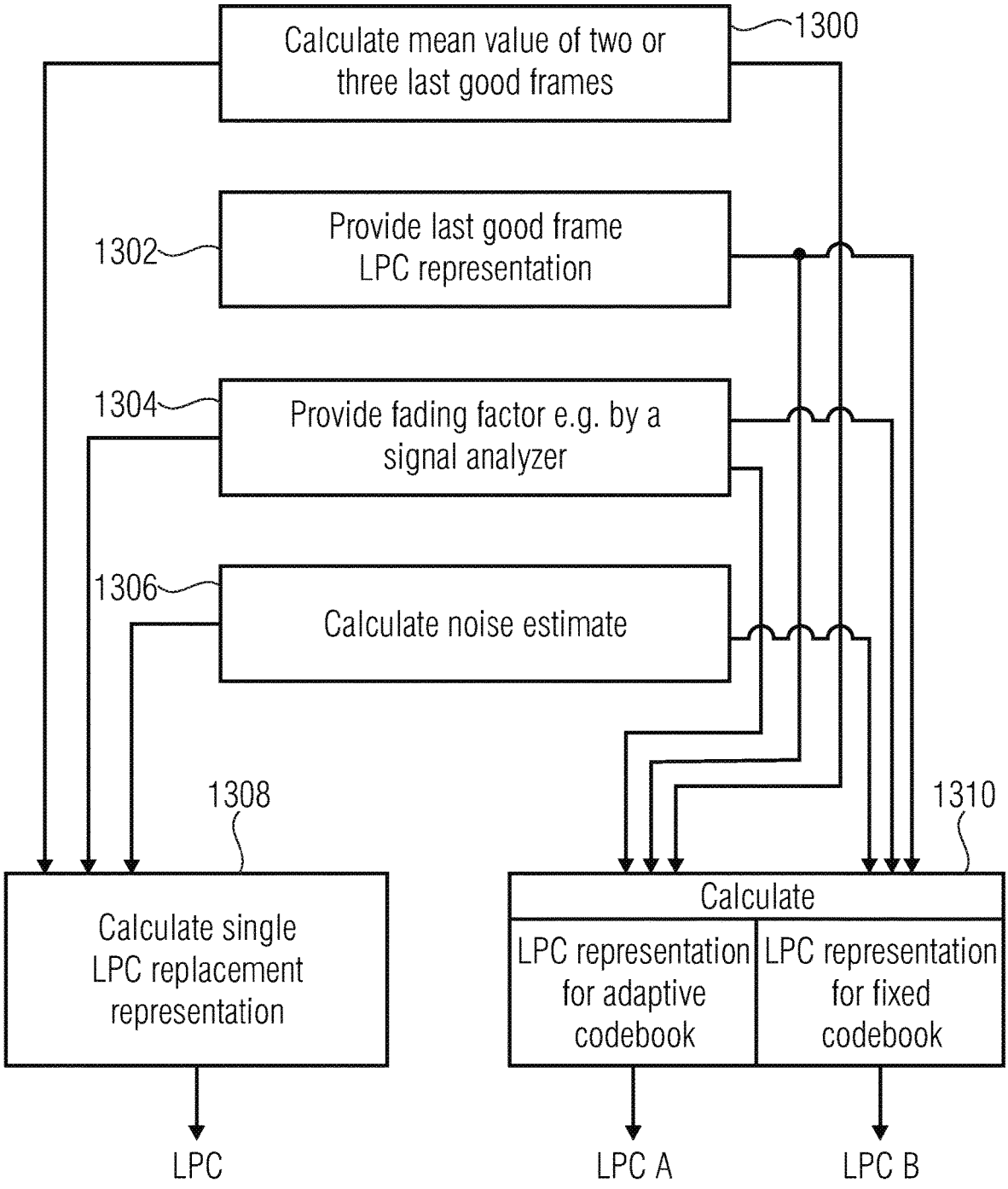
FIG. 13 illustrates the calculation of a single LPC replacement representation or individual LPC replacement representations for individual codebooks using a noise estimate and applying a fading operation.

Subsequently, FIG. 13 is discussed for illustrating the usage of the noise estimate in the context of the calculation of a single LPC replacement representation 1308 for the procedure, for example, illustrated in FIG. 8 or for calculating individual LPC representations for individual codebooks as indicated by block 1310 for the embodiment illustrated in FIG. 1.

In step 1300, a mean value of two or three last good frames is calculated. In step 1302, the last good frame LPC representation is provided. Furthermore, in step 1304, a fading factor is provided which can be controlled, for example, by a separate signal analyzer which can be, for example, included in the error concealment controller 200 of FIG. 2. Then, in step 1306, a noise estimate is calculated and the procedure in step 1306 can be performed by any of the procedures illustrated in FIGS. 12*a*, 12*b*.

In the context of calculating a single LPC replacement representation, the outputs of blocks 1300, 1304, 1306 are provided to the calculator 1308. Then, a single replacement LPC representation is calculated in such a way that subsequent to a certain number of lost or missing or erroneous frames/packets, the fading over to the noise estimate LPC representation is obtained.

However, individual LPC representations for an individual codebook, such as for the adaptive codebook and the fixed codebook, are calculated as indicated at block 1310, then the procedure as discussed before for calculating $ISF_A^{-1}$ (LPC A) on the hand and the calculation of $ISF_B^{-1}$ (LPC B) is performed.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a non-transitory storage medium such as a digital storage medium, or a computer-readable medium) comprising, recorded thereon, the computer program for performing one of the methods described herein. The data carrier, the digital storage medium or the recorded medium are typically tangible and/or non-transitory.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] ITU-T G.718 Recommendation, 2006

[2] Kazuhiro Kondo, Kiyoshi Nakagawa, "A Packet Loss Concealment Method Using Recursive Linear Prediction" Department of Electrical Engineering, Yamagata University, Japan.

[3] R. Martin, Noise Power Spectral Density Estimation Based on Optimal Smoothing and Minimum Statistics, IEEE Transactions on speech and audio processing, vol. 9, no. 5, July 2001

[4] Ralf Geiger et. al., Patent application US20110173011 A1, Audio Encoder and Decoder for Encoding and Decoding Frames of a Sampled Audio Signal

[5] 3GPP TS 26.190; Transcoding functions;—3GPP technical specification

The invention claimed is:

1. Apparatus for generating an error concealment signal, comprising:

an LPC (linear prediction coding) representation generator for generating a first set of LPC coefficients and a different second set of LPC coefficients;

an LPC synthesizer for filtering a first codebook vector using the first set of LPC coefficients to acquire a first replacement signal and for filtering a different second codebook vector using the second set of LPC coefficients to acquire a second replacement signal; and a replacement signal combiner for combining the first replacement signal and the second replacement signal to acquire the error concealment signal.

2. Apparatus of claim 1, further comprising:

an adaptive codebook for providing the first codebook vector; and a fixed codebook for providing the second codebook vector.

3. Apparatus of claim 2, wherein the fixed codebook is configured to provide a noise signal for the error concealment, and wherein the adaptive codebook is configured for providing an adaptive codebook content or an adaptive codebook content combined with an earlier fixed codebook content.

4. Apparatus of claim 1, wherein the LPC representation generator is configured to generate the first set of LPC coefficients using one or more non-erroneous preceding sets of LPC coefficients, and to generate the second set of LPC coefficients using a noise estimate and at least one non-erroneous preceding set of LPC coefficients.

5. Apparatus of claim 4, wherein the LPC representation generator is configured to calculate a mean value of sets of LPC coefficients of at least two last good frames and to generate the first set of LPC coefficients using a weighted summation of the mean value and a set of LPC coefficients of a last good frame, wherein a first weighting factor of the weighted summation changes over successive erroneous or lost frames, wherein the LPC coefficient generator is configured to generate the second set of LPC coefficients using a weighted summation of a set of LPC coefficients of a last good frame and a set of coefficients of the noise estimate, wherein a second weighting factor of the weighted summation changes over successive erroneous or lost frames.

6. Apparatus of claim 4 or 5, further comprising:

a noise estimator for estimating the noise estimate from one or more preceding good frames.

7. Apparatus of claim 1, wherein the LPC synthesizer comprises a first LPC synthesis filter for filtering the first codebook vector and a second LPC synthesis filter for filtering the second codebook vector, wherein the first LPC synthesis filter and the second LPC synthesis filter are used for an erroneous or lost frame, wherein the apparatus further comprises an LPC memory initializer for initializing, in case of a switching from a good frame to an erroneous or lost frame, first memory states of the first LPC synthesis filter and second memory states of the second LPC synthesis filter using memory states used for a good frame preceding an erroneous or lost frame.

8. Apparatus of claim 7, wherein the LPC synthesizer further comprises an LPC synthesis filter being different from the first LPC synthesis filter and the second LPC synthesis filter, wherein the apparatus further comprises an LPC memory initializer for initializing the single LPC synthesis filter in case of a recovery from an erroneous or lost frame to a good frame, the LPC memory initializer being configured for:

feeding at least a portion of a combination of the first codebook vector and the second codebook vector or at least a portion of a combined weighted first codebook vector and a weighted second codebook vector into the LPC synthesis filter, saving memory states acquired by the feeding; and initializing the single LPC synthesis filter using the saved memory states, when a subsequent frame is a good frame.

9. Apparatus of claim 1, further comprising a controller for controlling a feedback into a first codebook providing the first codebook vector, wherein the controller is configured to feed the first codebook vector back into the first codebook or to feed the combination of the first codebook vector and the second codebook vector back into the first codebook.

10. Apparatus of claim 1, further comprising:

a gain calculator for calculating a first gain information from the first set of LPC coefficients, and for calculating a second gain information from the second set of LPC coefficients;

a compensator for compensating a gain influence of the first set of LPC coefficients using the first gain information and for compensating a gain influence of the second set of LPC coefficients using the second gain information.

11. Apparatus of claim 10, wherein the gain calculator is configured to calculate:

a last good power information related to a last good set of LPC coefficients before a start of the error concealment, a first power information from the first set of LPC coefficients and a second power information from the second set of LPC coefficients, a first gain value using the last good power information and the first power information and a second gain value using the last good power information and the second power information, and wherein the compensator is configured for compensating using the first gain value and using the second gain value.

12. Apparatus of claim 10, wherein the gain calculator is configured to calculate an impulse response of a set of LPC coefficients and to calculate an RMS value from the impulse response to acquire a corresponding power information.

13. Apparatus of claim 1, wherein the LPC representation generator is configured to generate ISF vectors for the sets of LPC coefficients.

14. A method of generating an error concealment signal, comprising:

generating a first set of LPC coefficients and a different second set of LPC coefficients;

filtering a first codebook vector using the first set of LPC coefficients to acquire a first replacement signal and filtering a different second codebook vector, using the second set of LPC coefficients to acquire a second replacement signal; and combining the first replacement signal and the second replacement signal by summing-up the first replacement signal and the second replacement signal to acquire the error concealment signal.

15. Apparatus of claim 1, wherein the apparatus is configured to influence a spectral shape of tonal and noise like parts of the error concealment signal separately, or to play out a voiced signal part almost unchanged, while a noise part is converged to background noise, or to conceal a voiced part and fade out the voiced part with a fading speed dependent on a signal characteristics, and to maintain a background noise during concealment, or to fade to background noise during concealment by fading out a tonal part without changing a spectral property and by fading a noise like part to a background spectral envelope.

16. A non-transitory storage medium having a computer program stored thereon to perform, when running on a computer or a processor, a method of generating an error concealment signal, the method comprising:

generating a first set of LPC coefficients and a different second set of LPC coefficients;

filtering a first codebook vector using the set of LPC coefficients to acquire a first replacement signal and filtering a different second codebook vector using the second set of LPC coefficients to acquire a second replacement signal; and combining the first replacement signal and the second replacement signal to acquire the error concealment signal.

* * * * *